US009594341B2

(12) United States Patent
Kuruma et al.

(10) Patent No.: US 9,594,341 B2
(45) Date of Patent: Mar. 14, 2017

(54) IMAGE FORMING APPARATUS HAVING LOCKING CARTRIDGE TRAY

(71) Applicant: CANON KABUSHIKI KAISHA, Tokyo (JP)

(72) Inventors: Tomoya Kuruma, Yokohama (JP); Yuichiro Osawa, Kamakura (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/571,854

(22) Filed: Dec. 16, 2014

(65) Prior Publication Data

US 2015/0168911 A1 Jun. 18, 2015

(30) Foreign Application Priority Data

Dec. 17, 2013 (JP) ..... 2013-259762

(51) Int. Cl.
*G03G 15/00* (2006.01)
*G03G 21/16* (2006.01)

(52) U.S. Cl.
CPC ..... *G03G 21/1647* (2013.01); *G03G 21/1623* (2013.01)

(58) Field of Classification Search
CPC ..... G03G 21/1853; G03G 21/1814; G03G 21/1647; G03G 21/1623
USPC ..... 399/110, 111
See application file for complete search history.

(56) References Cited

U.S. PATENT DOCUMENTS

2008/0292355 A1* 11/2008 Sakurai ..... G03G 21/1853 399/110
2014/0147158 A1 5/2014 Fujinaka et al.

FOREIGN PATENT DOCUMENTS

JP 5059223 B2 10/2012

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes a main assembly including an opening, a cartridge tray for dismountably supporting a cartridge, an openable member for opening and closing the opening, with the cartridge tray being provided at one end portion side, and a limiting member. An urging member urges the cartridge tray from an inner position in the main assembly to an outer position, and a locking member moves between a regulating position and a non-regulating position in interrelation with movement of the openable member. When the openable member is closed, the locking member moves to the regulating position at which the locking member engages with the cartridge tray to push it to the inner position and limits movement of the cartridge tray toward the outer position, and when the openable member is opened, the locking member moves to the non-regulating position at which the locking member disengages from the cartridge tray.

19 Claims, 25 Drawing Sheets

IMAGE FORMING APPARATUS HAVING LOCKING CARTRIDGE TRAY

FIELD OF THE INVENTION AND RELATED ART

The present invention relates to an image forming apparatus for forming an image on a recording material.

Here, the image forming apparatus is an apparatus using a known image forming process such as an electrophotographic process, an electrostatic recording process or a magnetic recording process. More particularly, it includes a copying machine, a printer (laser beam printer, LED printer, for example), the facsimile machine, a word processor, an image display device (electronic blackboard electronic white board) and so on. The recording material is a material on which an image is formed by the image forming apparatus, and it includes a sheet of paper, an OHT sheet in the image displaying member.

A cartridge is a unit which includes an image bearing member on which the image is formed, and part or all of the image forming process means actable on the image bearing member and which is unified into a cartridge. The cartridges detachably are mounted to a main assembly of an image forming apparatus and contribute to image forming process for forming an image on the recording material. The main assembly is part of the image forming apparatus except for the cartridge, in the cartridge type image forming apparatus.

The image bearing member may be an electrophotographic photosensitive member in the case of an electrophotographic process, a dielectric member for electrostatic recording in the case of an electrostatic recording process, a magnetic member for magnetic recording in the case of a magnetic recording process, or a member on which an image can be performed using another image forming process. The image forming process means is equipment actable on the image forming apparatus to form the image on the recording material.

In the following, the description will be made as to a cartridge type electrophotographic image forming apparatus, as an exemplary structure. As for the cartridge, there are a process cartridge and a developing cartridge.

The process cartridge comprises at least one of charging means, developing means and cleaning means as the electrophotographic process means, and an electrophotographic photosensitive member unified into a cartridge detachably mountable to the main assembly of the electrophotographic image forming apparatus.

Therefore, the process cartridge may be a cartridge comprising the developing means as the process means, and the electrophotographic photosensitive member which is unified into a cartridge detachably mountable to the main assembly of the image forming apparatus. The process cartridge may be a cartridge comprising an electrophotographic photosensitive member and charging means, developing means or cleaning means as the process means, which are unified into a cartridge detachably mountable to the main assembly of the image forming apparatus.

A cartridge comprising an electrophotographic photosensitive member in the developing means as a unit is called an integral type process cartridge. A cartridge comprising an electrophotographic photosensitive member and a process means other than the developing means is called a separable type process cartridge. In this case, the developing means is included in another unit, that is, a developing unit, which is used with the separable type process cartridge to form the image.

The process cartridge can be mounted to and dismounted from the main assembly of the image forming apparatus by the user. Therefore, the maintenance operation of the image forming apparatus can be effected without difficulty.

The developing cartridge comprises a developer carrying member (developing roller) for applying a developer and to the electrophotographic photosensitive member. It accommodates a powdery developer (toner) for developing the electrostatic latent image formed on the electrophotographic photosensitive member, using the developing roller, and the developing cartridge can be detachably mounted to the main assembly of the apparatus.

In the case of the developing cartridge, the electrophotographic photosensitive member is mounted to the main assembly of the apparatus or a supporting member of the cartridge. Or, in the case of the separable type process cartridge, the electrophotographic photosensitive member is provided in the process cartridge which per se does not include the developing means. The developing cartridge can be detachably mounted to the main assembly of the apparatus by the user, too. Therefore, the maintenance operation of the image forming apparatus can be carried out, in effect, without difficulty.

The cartridge in this invention may be an integral type or separable type cartridge. In addition, the cartridge may be a combination of the separable type process cartridge and the developing cartridge. Furthermore, the cartridge may be developing cartridge which is detachably mountable to the main assembly having an electrophotographic photosensitive member fixed therein, in which the developing cartridge is actable on the electrophotographic photosensitive member when it is mounted to the main assembly. The cartridge may be a unit contributable to the image formation process for forming the image on the recording material, the unit being detachably mountable to the main assembly of the apparatus.

In known structures, a plurality of process cartridges are mounted on a movable tray (movable member, cartridge supporting member) along a horizontal direction, and when the tray is drawn out of the main assembly of the apparatus, the process cartridges can be dismounted and mounted.

In one of such structures, the tray is urged toward the outside of the main assembly of the apparatus, so that when the tray is released from the locking, the tray pops out by a predetermined distance (Japanese patent 5059223). With such a structure, the usability is improved. In addition, if the tray is insufficiently pushed into the main assembly of the apparatus when the tray is inserted into the main assembly, the tray may pop out, and therefore, the above the structure improves the usability in the sense that the sufficient insertion it assured.

The present invention provides a further improvement of such prior-art. It is another object of the present invention to provide an image forming apparatus with which the main assembly of the apparatus is downsized, the cost is reduced, and the usability is further improved.

SUMMARY OF THE INVENTION

According to an aspect of the present invention, there is provided an image forming apparatus, to which a cartridge is detachably mountable, for forming an image on a recording material, said apparatus comprising a main assembly including an opening; a cartridge tray for dismountably supporting a cartridge, said cartridge tray being movable through said opening between an outer position and an inner position; an openable member for opening and closing said opening; a limiting member provided at one end portion side of said cartridge tray with respect to the longitudinal direction, said limiting member being movable in the inner position between a limiting position in which movement of said cartridge tray toward the outer position is limited by engagement with a main assembly side engaging portion of the main assembly and a release position in which said cartridge tray is disengaged from the main assembly side engaging portion; at least one urging member, provided upstream of said limiting member with respect to an outward direction which is toward the outer position, for urging said cartridge tray from the inner position to the outer position, said at least one urging member providing a resultant force effective to apply a rotational force to said cartridge tray in a direction of projecting the other end portion side beyond the one end portion side, when said limiting member is in the limiting position; and a locking member interrelated with said openable member, wherein when said openable member is closed, said locking member engages with the other end portion side of said cartridge tray with respect to the longitudinal direction to push said cartridge tray to the inner position and limits downstream movement of said cartridge tray toward the outer position, and wherein when said openable member is opened, said locking member disengages from said cartridge tray.

Further features of the present invention will become apparent from the following description of exemplary embodiments with reference to the attached drawings.

DESCRIPTION OF THE EMBODIMENTS

Embodiment 1

General Arrangement

Figure 1:
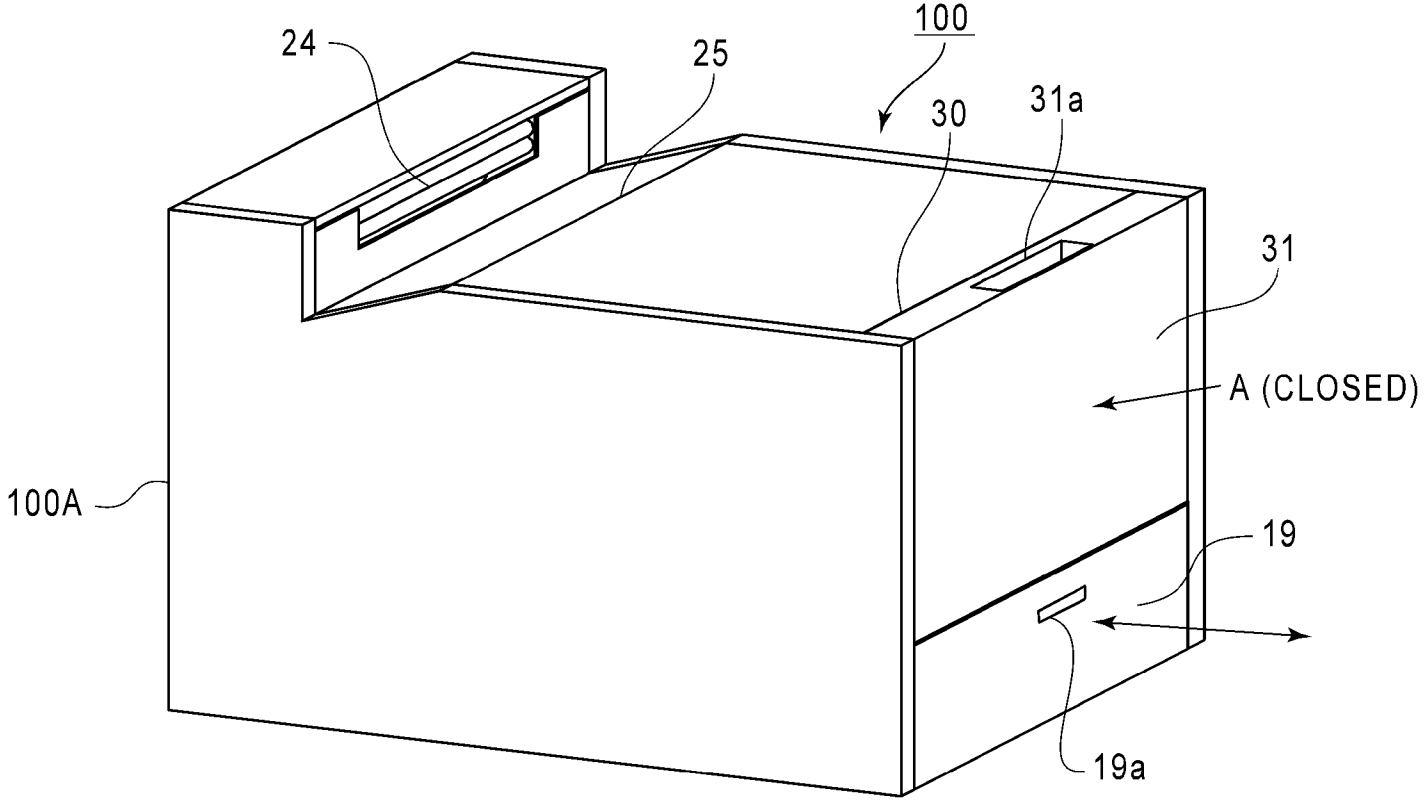
FIG. 1 is a perspective view of an outer appearance of an image forming apparatus according to an embodiment of the present invention.

FIG. 1 is a perspective view of an outer appearance of an image forming apparatus 100 according to an embodiment of the present invention. The image forming apparatus 100 is an electrophotographic process type four full-color laser beam printer (electrophotographic image forming apparatus), which comprises first to fourth cartridges P (PY, PM, PC and PK) as a plurality of cartridges.

The image forming apparatus 100 receives an electrical image signal supplied from an outer host apparatus 400 to a controller 200 through an interface portion 300, and a forms a four full-color image or a monochromatic image on a recording material S in the form of a sheet on the basis of the electrical image signal. In the following, the recording material is called a sheet. The outer host apparatus 400 may be a personal computer, an image reader, a sender part of a facsimile machine or the like.

The controller 200 is a controlling means for controlling the electrophotographic image forming process of the image forming apparatus 100, and it communicates with the outer host apparatus 400. It also carries out processing of the electrical information supplied from various process means or sensor, processing of instruction signal to various process means, predetermined initial sequence control, sequence control of the electrophotographic image forming process or the like.

In the following description, the front side of the image forming apparatus 100 is the side provided with an opening and closing door 31. A rear side is a side opposite therefrom. A front-rear direction is a direction from a rear side toward the front side of the image forming apparatus 100 and the direction opposite thereto. Left and right of the image forming apparatus 100 are the left and right as seen from the front side. Left-right direction is the direction from the right-hand side toward the left-hand side or the direction opposite thereto. Up and down are based on the direction of gravity. An upward direction is the direction from a lower side toward the upper side, and a downward direction is the direction from an upper side toward a lower side.

A longitudinal direction is a direction substantially parallel with a rotational axis direction of a rotatable member (rotatable image bearing member and/or developer carrying member) of the cartridge. A widthwise direction is a direction substantially perpendicular to the longitudinal direction. One end portion side with respect to the longitudinal direction is a driving side, and the other end portion side is a non-driving side. In this embodiment, the right-hand end side with respect to the longitudinal direction is the driving side, and the left-hand end side is the non-driving side.

A main assembly (main assembly frame) 100A of the image forming apparatus 100 is provided therein with an accommodating portion 100B. In the cartridge accommodating portion 100B, the first to fourth cartridges PY, PM, PC, PK are mounted at respective predetermined positions along a horizontal direction (tandem type). The mounting position of the cartridge P is the position where the image forming function can be performed.

The cartridge P is contributable to the operation of the image forming process for forming the image on the sheet S, and is detachably mountable to the main assembly 100A of the image forming apparatus 100. In this embodiment, each cartridge P includes a drum type electrophotographic photosensitive member (drum) as a rotatable image bearing member and which a latent image is formed. It is a process cartridge including as a unit charging means 2, developing means 3 and cleaning means 4 as electrophotographic image forming process means.

In this embodiment, the charging means 2 is a contact type charging roller. The developing means 3 includes a developing roller 3*a* as a developer carrying member for developing the latent image into a developer image by supplying a developer to the drum 1, and a developer accommodating portion 3*b* for accommodating the developer, and is a contact type or non-contact type developing device. The cleaning means 4 is a blade cleaning device including a cleaning blade 4*a* as a cleaning member and a residual toner accommodating portion 4*b*. Each cartridge P is provided with such an electrophotographic processing mechanism, but the cartridges P contain different color developer (toner).

More particularly, the first cartridge PY contains yellow (Y) toner in the developing device 3 and forms a Y color toner image on the surface of the drum 1. The second cartridge PM contains magenta (M) toner in the developing device 3 and forms an M color toner image on the surface of the drum 1. The third cartridge PC contains cyan (C) toner in the developing device 3 and forms a C color toner image on the surface of the drum 1. The second cartridge PM contains magenta (M) toner in the developing device 3 and forms an M color toner image on the surface of the drum 1.

Above the cartridges PY, PM, PC and PK, there is provided a laser scanner unit 11 as an exposure device unit (exposure means) for forming a latent image by exposing the drum 1 with image light. The scanner unit 11 produces a laser beam modulated in accordance with image information signal for each color supplied from an external host apparatus 400 to the controller 200, and the laser beam is scanningly projected to the surface of the drum 1 of the cartridge P through the exposure window 6 provided in the top surface of the cartridge frame 5.

Below the cartridges PY, PM, PC and PK, there is provided an intermediary transfer unit 12 as a transfer unit (transfer member), opposed to the respective drums 1 of the cartridges P, for primary-transferring the toner image from the drum and secondary-transferring the toner images onto the sheet.

The unit 12 includes a flexible endless belt 13 of dielectric member as an intermediary transfer member (second image bearing member, intermediary recording material), a driving roller 14, turning roller 15 and a tension roller 16, for stretching and drive the belt 13 along a circulation path. The driving roller 14 and the turning roller 15 are provided in the rear side of the main assembly 100A. The tension roller 16 is provided in the front side of the main assembly 100A.

In the state that the cartridges P are mounted at the respective predetermined positions, the lower surfaces of the drums 1 contact to the upper surface of the upper traveling portion of the belt 13. Inside the belt 13, there are provided four primary transfer rollers 17 opposed to the respective drums 1 of the cartridges P with the upper traveling portion of the belt interposed therebetween.

Each of the cartridges P, a nip between the drum 1 and the belt 13 is a primary transfer nip T1. To the driving roller 14, the secondary transfer roller 22 is urged through the belt 13. A nip between the secondary transfer roller 22 and the belt 13 is a secondary transfer nip T2.

Below the intermediary transfer unit 12, there is provided a sheet feeding unit 18 for storing the sheets for receiving the toner images and for feeding the sheets S one by one to the intermediary transfer unit 12.

The sheet feeding unit 18 includes a sheet feeding tray 19 accommodating a stack of sheets S, a sheet feeding roller 20, a separation pad 21, a pair of registration rollers, and so on. The sheet feeding tray 19 can be inserted into and drawn out of the main assembly 100A (front loading). The sheet feeding tray 19 is provided on the front side plate with a grip portion 19*a*.

In an upper portion of the rear side of the main assembly 100A, there is provided a pair of discharging rollers and a fixing device 23 as a fixing unit (fixing means) for fixing the toner image on the sheet S by heat and pressure The upper surface of the main assembly 100A functions as a sheet discharge tray 25. The fixing device 23 includes a fixing film assembly 23*a* and pressing roller 23*b*. The sheet discharging roller pair 24 includes a sheet discharging roller 24*a* and a sheet discharge roller 24*b*.

In the cartridge accommodating portion 100B, the cartridges P are positioned at the respective of the portions in which the image forming operation is possible, and are urged by urging members 42 (part (a) of FIG. 22), which will be described hereinafter. They are fixed by predetermined position determination portions 41 and rotation stopper pins 801 provided in the main assembly 100A.

As will be described hereinafter, a drive inputting portion (drive connecting portion) 53, 54 (FIG. 8) of the cartridge P is engaged with a drive outputting portion (main assembly drive transmission member) 39, 40*a* (FIGS. 24, 25) provided in the main assembly 100A. By this, a driving force can be transmitted to the cartridge P.

As will be described hereinafter, the cartridge P is provided with an electrical contact (electric power supply contact portion) 55 (FIG. 7), to which an electric energy supply line (electric energy supply member) 75 (FIG. 18) of the main assembly 100A is electrically connected.

(Image Forming Operation)

The operation for forming the full-color image is as follows. The drums 1 in the first-fourth each cartridges PY, PM, PC and PK are rotated in the counterclockwise direction as indicated by an arrow in FIG. 2 at a predetermined control speed. Also, the belt 13 is rotated at the speed corresponding to the peripheral speed of the drum 1 in the clockwise direction indicated by an arrow (codirectionally with the peripheral movement of the drum 1). The scanner unit 11 is also driven.

In synchronism with the drive, the charging rollers 2 charge the surfaces of the respective drums 1 at predetermined control timings. The scanner unit 11 emits the laser beam L modulated in accordance with the image signals of the respective colors onto the surfaces of the respective drums 1. By this, electrostatic latent images are formed on the surfaces of the drums 1, correspondingly to the image signals of the respective colors. The formed latent images are developed into toner images (developer image) by the developing device 3.

Through the above-described electrophotographic image forming process operations, a Y color toner image corresponding to the Y color component of the full-color image is formed on the drum 1 of the first cartridge PY. The toner image is primary-transferred onto the belt 13 in the primary transfer nip T1 of the cartridge PY.

An M color toner image corresponding to the M color component of the full-color image is formed on the drum 1 of the second cartridge PM. This toner image is primary-transferred superimposedly onto the Y color toner image already transferred on the belt 13 at the primary transfer nip T1 of the cartridge PM.

A C color toner image corresponding to the C color component of the full-color image is formed on the drum 1 of the third cartridge PC. This toner image is primary-transferred superimposedly onto the Y plus M color toner images already transferred on the belt 13 at the primary transfer nip T1 of the cartridge PM.

A K color toner image corresponding to the K color component of the full-color image is formed on the drum 1 of the fourth cartridge PK. This toner image is primary-transferred superimposedly onto the Y plus M plus C color toner images already transferred on the belt 13 at the primary transfer nip T1 of the cartridge PC.

In this manner, Y plus M plus C plus K superimposed toner images (unfixed) are formed. In each of the cartridges, the untransferred toner remaining on the surface of the drum 1 after the primary-image transfer of the toner image onto the belt 13 is removed by the cleaning device 4.

On the other hand, the sheet feeding roller 20 is driven and predetermined control timing. Then, by the cooperation of the sheet feeding roller 20 and the separation pad 21, the sheet S is singled out from the stack of the sheets on the sheet feeding tray 19, and is introduced into the secondary transfer nip T2 by the registration rollers 20*a* at predetermined control timing. By this, the sheet S is nipped and fed through the secondary transfer nip T2, during which the four color toner images are sequentially transferred all together onto the surface of the sheet S.

The sheet S is then separated from the surface of the belt 13 and is introduced into the fixing device 23 along the feeding path 20*b*, and it the depth and depressed by the fixing nip N. By this, the four color toner images are mixed and fixed on the sheet S. The sheet S is then discharged from the fixing device 23 onto the sheet discharge tray 25 by the pair of sheet discharging rollers 24 as a full-color print. The secondary-untransferred toner remaining on the surface of the belt 13 after the separation of the recording material is removed by the cleaning means 26.

(Cartridge Exchanging Type)

In the first-fourth each cartridges PY, PM, PC and PK, the developers accommodating the developing devices 3 are consumed with the image forming operation. When the developer is consumed up to such an extent that an image of the quality with which the user is satisfied cannot be formed, the commercial value of the cartridge is lost.

Therefore, a means (unshown) for detecting a developer remainder in each cartridge is provided to compare the detected remaining amount with a threshold for cartridge lifetime forenotice or lifetime warning, using the controller 200. Wherein the detected remaining amount reaches the threshold, the lifetime forenotice or lifetime warning is displayed on the display portion (unshown) of the cartridge. By doing so, the user is prompted to prepare a fresh cartridge or exchange of the cartridge so as to maintain the quality of the output images.

Regarding the method for replacing a cartridge (cartridges) in the image forming apparatus 100 in this embodiment, in order to improve the image forming apparatus 100 in usability, the image forming apparatus 100 is provided with a cartridge tray 35 (cartridge drawer: movable member). That is, the cartridges P are placed in the tray 35 which can be pulled out of the main assembly 100A of the image forming apparatus 100, in the frontward direction, so that the cartridges P can be accessed from the front side of the image forming apparatus 100.

More concretely, the front panel of the main assembly 100A of the image forming apparatus 100 is provided with an opening 30, through which the cartridges P can be inserted into, or moved out of, the cartridge chamber 100B in the apparatus main assembly 100A.

Figure 2:
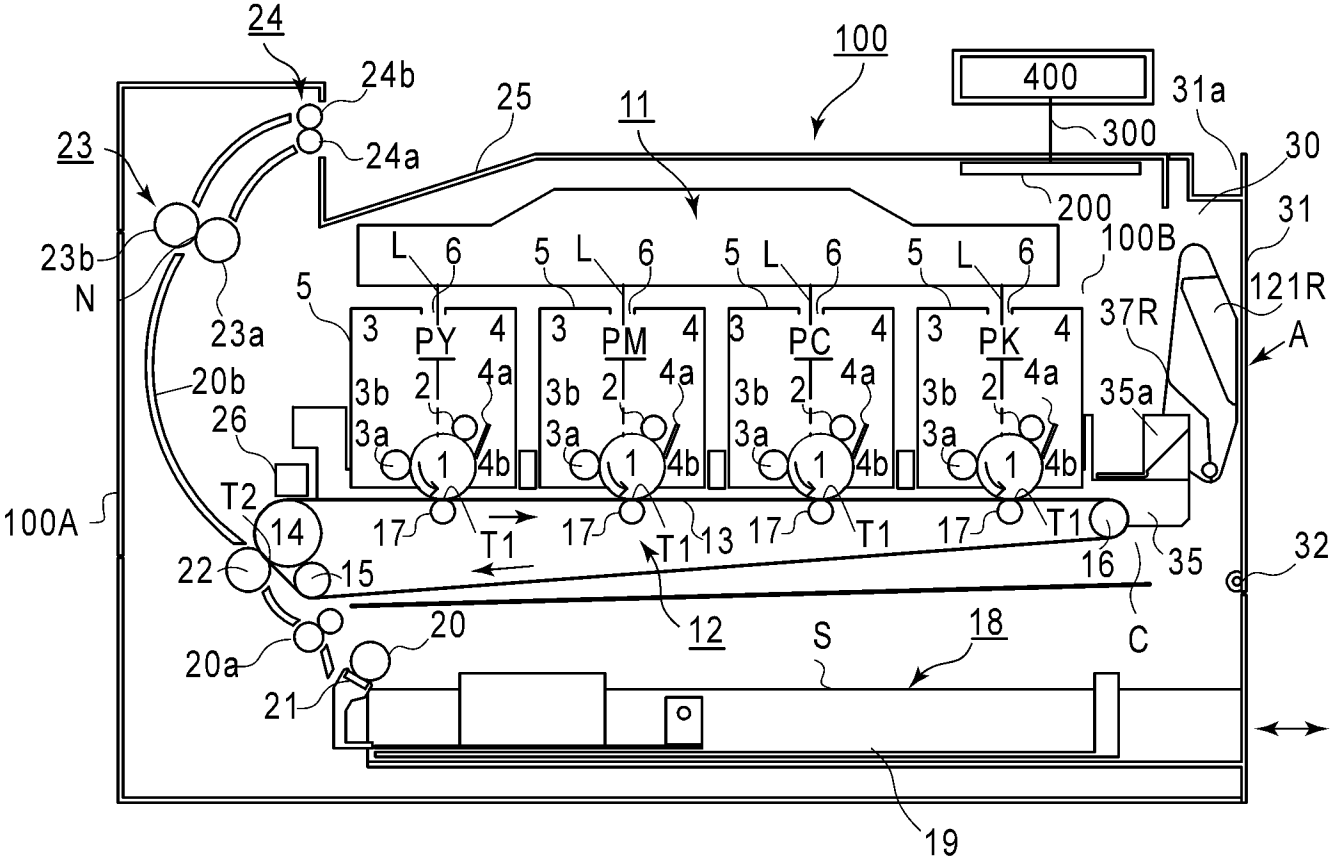
FIG. 2 is a right-hand sectional side view of the image forming apparatus.
Figure 3:
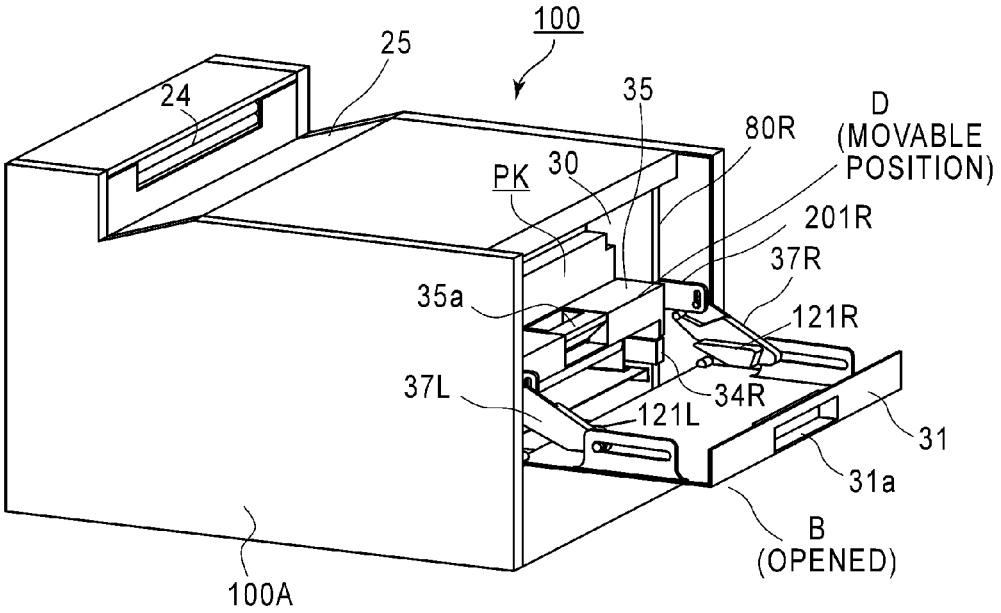
FIG. 3 is a perspective view of the outer appearance of the image forming apparatus in which a door is open.
Figure 4:
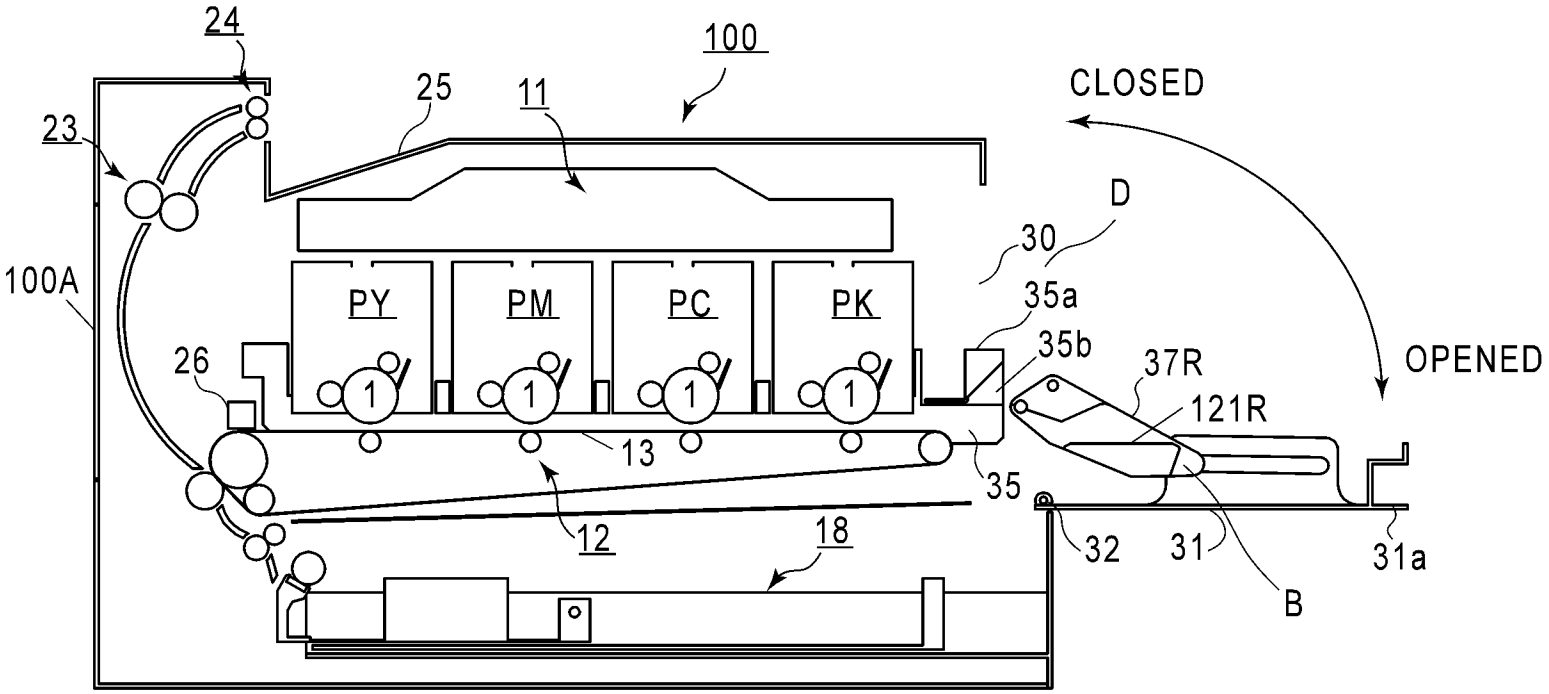
FIG. 4 is a right-hand sectional side view of the image forming apparatus in the state shown in FIG. 3.

Referring to FIGS. 1 and 2, the apparatus main assembly 100A is provided with a main assembly door 31 (member which can be opened or closed) which can be rotationally moved between a closed position A in which the door 31 keeps the opening 30 completely covered, as shown in FIGS. 3 and 4, and an open position B in which the door 31 keeps the opening 30 fully exposed. Designated by a referential code 31*a* is a finger-hold with which the door 31 is provided. That is, the main assembly door 31 is enabled to remain in the closed position A in which it keeps the opening 30 completely covered, and the open position B in which it keeps the opening 30 fully exposed.

In this embodiment, this door 31 is rotatably movable about a horizontal shaft 32 (hinge shaft), which is located at the bottom edge of the door 31, to be opened or closed. That is, the door 31 can be rotatably moved upward about the hinge shaft 32, to be closed relative to the apparatus main assembly 100A. As the door 31 is closed, the opening 30 is completely covered.

Further, the door 31 can be rotatably moved frontward of the apparatus main assembly 100A, about the hinge shaft 32, to be virtually horizontally placed. That is, the door 31 can be rotatably moved away to be opened relative to the apparatus main assembly 100A, as shown in FIGS. 3 and 4. As the door 31 is fully opened, the opening 30 of the front panel of the apparatus main assembly 100A is fully exposed. Designated by the referential code 31*a* is a finger-hold for opening or closing the door 31, with which the door 31 is provided.

The apparatus main assembly 100A has a main frame (main assembly frame) which makes up the main structure of the apparatus main assembly 100A. Referring to FIGS. 13-15, 17, 19, 23, etc., the apparatus main assembly 100A is provided with left and right sub-frames 80L and 80R, which are the left and right lateral plates of the main frame. The apparatus main assembly 100A is also provided with a pair (left and right) of tray holding members 34L and 34R (movable means), which are on the immediately inward side of the left and right sub-frames 80L and 80R, that is, the left and right lateral plates, respectively.

The cartridge tray 35 is in the form of a rectangular frame. It is held on the tray holding members 34L and 34R in such a manner that it can be slid between a position D, shown in FIG. 4, and a position E, shown in FIGS. 5 and 6, while remaining between the left and right sub-frames 80L and 80R. The position D, which hereafter will be referred to as "locking-unlocking position", is such a position that allows the tray 35 to be pulled out of the apparatus main assembly 100A, and also, is the position into which the tray 35 moves before it is moved downward as it is pushed into the apparatus main assembly 100A. The position E, which hereafter will be referred to as "mounting-dismounting position", is such a position that allows cartridges P to be mounted into, or moved out of, the tray 35. The cartridges PY, PM, PC and PK are mounted in this tray 35 and are supported by the tray 35.

The tray 35 is a movable member which can be slid in the direction (vertical direction) which is perpendicular (intersectional) to the axial line of the drum 1 in each cartridge P when the cartridge P is in the tray 35. That is, the direction in which the tray 35 can be moved between the locking-unlocking position D and mounting-dismounting position E is perpendicular to the lengthwise direction of each cartridge P. Further, the tray 35 can hold multiple (four in this embodiment) cartridges P in such a manner that the cartridges P are placed in tandem, also, in parallel to each other, in the direction in which the tray 35 is movable between the positions D and E.

That is, the tray 35 which is a movable member moves while holding one, or two or more cartridges P, between the two sub-frames 80L and 80R, or the lateral plates, of the apparatus main assembly 100A, which oppose each other.

When the door 31 is in the closed position A as shown in FIGS. 1 and 2, the tray 35 remains in its image formation position (designated inside position) in which it keeps each cartridge P in a position (image formation position) in which the cartridge can form images. In this embodiment, the image formation position C of the tray 35 is such a position that keeps the drum 1 in each cartridge P in contact with the belt 13 of an intermediary transfer unit 12 (FIG. 2).

As the door 31 is rotationally moved in the opening direction, the tray holding members 34L and 34R are moved by a preset amount in both the frontward and upward directions by the rotational opening movement of the door 31, as will be described later. Consequently, the tray which is holding the cartridges PY, PM, PC and PK is moved from the above described image formation position C, in both the frontward and upward directions, into the locking-unlocking position D as shown in FIGS. 3 and 4. As the tray 35 is moved as described above, the drum in each of the cartridges P supported by the tray 35 separates from belt 13 as shown in FIG. 4. The mechanism which causes the tray holding members 34L and 34R to be moved by the rotational movement of the door 31 will be described later.

Also as the door 31 is rotationally opened, the electrical connection between the electrical contact 55 of each cartridge P and the power supply system 75 of the apparatus main assembly 100A is broken (power supply disruption), as will be described later. Further, the mechanical driving force input portions 53 and 54 of each cartridge P, and the mechanical driving force output portions 39 and 40 (mechanical driving force transmitting portions of apparatus main assembly), are disengaged from each other (cessation of driving force transmission). Moreover, the pressure applied to each cartridge P by the pressing member 42 to keep the cartridge precisely positioned is removed (pressure removal).

If a user wants to pull the tray 35 out of the apparatus main assembly 100A, from the locking-unlocking position D, to the mounting-dismounting position E, the user is to grasp the handle 35*a* (tray releasing (limiting) means), with which the front sub-frame portion 35*b* of the tray 35, and which is exposed through the opening 30, at this point of operation, as shown in FIGS. 3 and 4, while the apparatus main assembly 100A is in the above described state. As the user grasps the handle 35*a* in a preset manner, the ejection prevention pawl 101 (movement regulating means) is disengaged from the pawl latching portion 102 (pawl engaging portion of apparatus main assembly 100A) as indicated by parts (a) and (b) of FIG. 15.

The ejection prevention pawl 101 is a regulating member with which one end of the tray 35 is provided. When the tray 35 is in the mounting-dismounting position E, the ejection prevention pawl 101 is movable between a regulating position Q (FIG. 26) in which it remains engaged with the pawl latching portion 102 of the apparatus main assembly 100A to prevent the tray 35 from moving in the direction in which it can be pulled out of the apparatus main assembly 100A, and a disengagement position R in which it remains disengaged from the pawl latching portion 102 of the apparatus main assembly 100A. The above described handle 35*a* of the tray 35 functions also as a disengaging member which is for moving the ejection prevention pawl 101 from the regulating position Q to the disengagement position R.

The tray 35 is kept pressed by a tray pressing member 104 which remains under the pressure generated by a spring 103. Thus, as the ejection prevention pawl 101 becomes disengaged from the pawl latching portion 102 of the apparatus main assembly 100A, the tray 35 is automatically pushed out of the apparatus main assembly 100A by a preset amount (distance). Therefore, even if the user releases the handle 35*a*, it does not occur that the ejection prevention pawl 101 engages again with the pawl latching portion 102 of the apparatus main assembly 100A.

Figure 5:
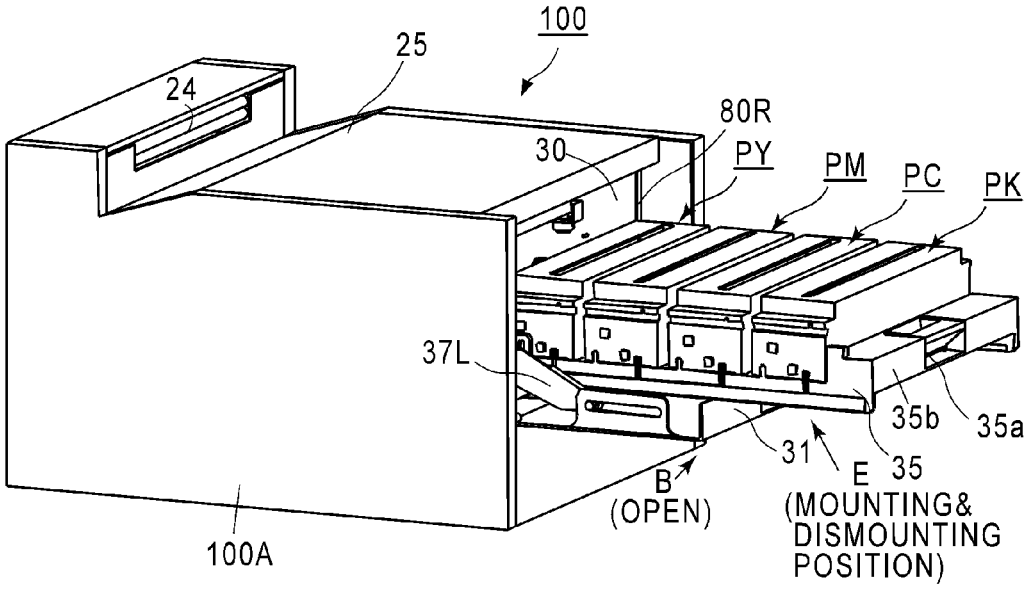
FIG. 5 is a perspective view of the outer appearance of the image forming apparatus in which a tray is drawn out.
Figure 6:
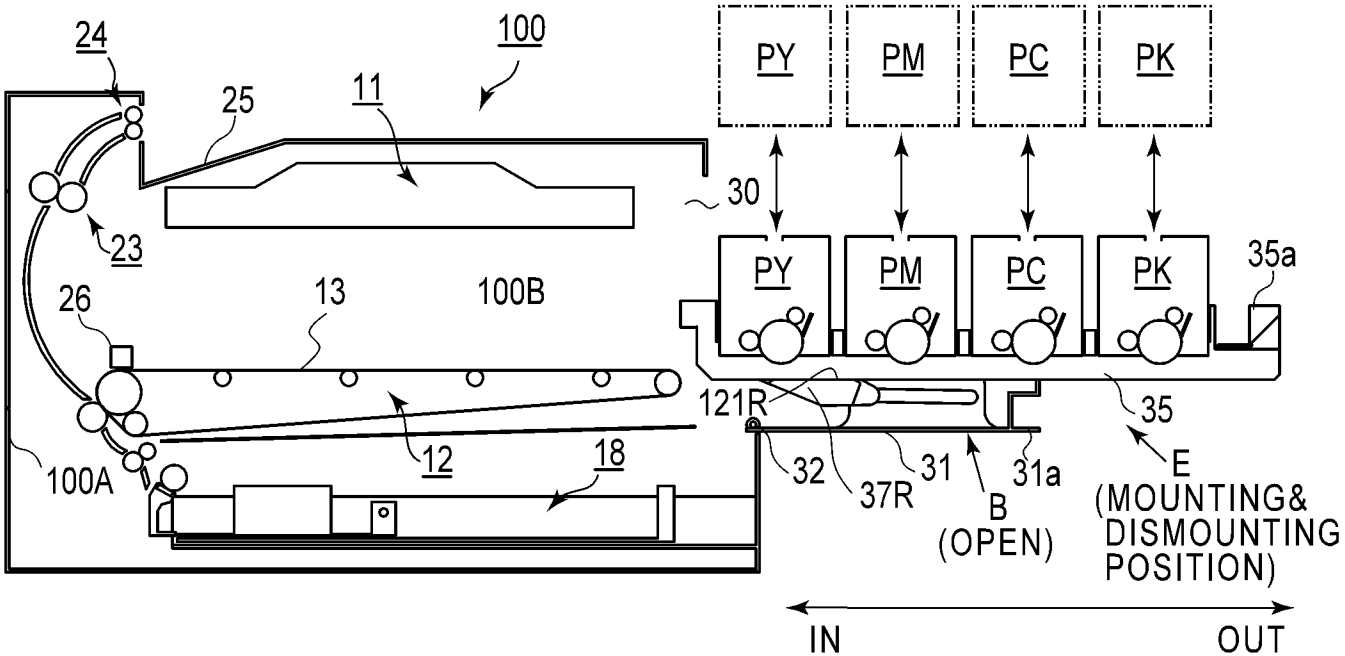
FIG. 6 is a right-hand sectional side view of the image forming apparatus in the state shown in FIG. 5.

Thus, it becomes possible for the tray 35 to be pulled out of the apparatus main assembly 100A, all the way from the locking-unlocking position D in the apparatus main assembly 100A. That is, it becomes possible for the tray 35 to horizontally slide frontward of the apparatus main assembly 100A, on the tray holding members 34L and 34R, being thereby enabled to be moved to the preset outward position, that is, the mounting-dismounting position E in which the tray 35 is protrusive from the apparatus main assembly 100A through the opening 30, allowing a cartridge P to be mounted into the tray 35, or the cartridge P in the tray 35 to be removed from the tray 35, as shown in FIGS. 5 and 6.

That is, as the door 30 is fully opened, all of the four (first to fourth) cartridges PY, PM, PC and PK held by the tray 35 are moved out of the apparatus main assembly 100A through the opening 30, being thereby exposed from the apparatus main assembly 100A in such a manner that all cartridges are exposed upward. As the tray 35 is moved outward from the locking-unlocking position D by a sufficient amount, it is prevented by an unshown stopper from being pulled out further. Further, as the tray 35 is horizontally pulled out of the apparatus main assembly 100A to the mounting-dismounting position E, it is kept horizontally in the mounting-dismounting position E by the combination of the tray holding members 34L and 34R, and connective arms 37L and 37R, which will be described later.

When the tray 35 is in the mounting-dismounting position E, it holds each cartridge P in such a manner that the cartridge P can be moved upward to be moved out of the tray 35. Further, the tray 35 supports each cartridge P in a manner to prevent the cartridge from moving vertically downward. Thus, a used cartridge(s) in the tray 35, which needs to be replaced, can be pulled upward to be extracted from the tray 35. Then, a brand-new cartridge(s) can be mounted into the tray 35 from above the tray 35 so that it can be supported by the tray 35. That is, it is when the tray 35 is in its outward position relative to the apparatus main assembly 100A that a cartridge P can be mounted into, or removed from, the apparatus main assembly 100A.

In the case of the apparatus main assembly 100 in this embodiment, its tray 35 supports the cartridges PY, PM, PC and PK in the listed order, in terms of the direction in which the tray 35 is moved from the locking-unlocking position D to the mounting-dismounting position E, that is, the upstream to downstream direction. That is, it supports the cartridges PY, PM, PC and PK which contain yellow (Y), magenta (M), cyan (C) and black (K) developers, respectively, in parallel, in the listed order. In other words, the tray 35 supports the multiple (four in this embodiment) cartridges P, which are different in developer color, in such a manner that the cartridge BK, or the cartridge which contains black (K) developer, is positioned most downstream in terms of the direction in which the tray 35 is moved from the locking-unlocking position D to the mounting-dismounting position E.

The cartridge PK is greater in developer consumption than other cartridges. That is, it is highest in replacement frequency. Thus, it is supported by the tray 35 in such a manner that it is on the most frontward side of the apparatus main assembly 100A. Therefore, all that is to be done when it is necessary for the cartridge PK to be replaced is that the tray 35 is to be slightly pulled out of the apparatus main assembly 100A to expose only the cartridge PK from the apparatus main assembly 100A. That is, if it is only the cartridge PK that needs to be replaced, it is unnecessary for the tray 35 to be entirely pulled out, that is, to the position in which it is regulated in position by the stopper. In other words, this embodiment improves an image forming apparatus in efficiency in terms of cartridge replacement.

That is, when it is only the cartridge PK, which is the downstream most cartridge in terms of the direction in which the tray 35 is pulled out of the apparatus main assembly 100A, that needs to be replaced, it is unnecessary that the tray 35 is entirely out of the apparatus main assembly 100A. That is, the tray 35 does not need to be in the mounting-dismounting position E. All that is necessary is for the tray 35 to be slightly pulled out of the apparatus main assembly 100A, that is, far enough to expose only the cartridge PK from the apparatus main assembly 100A. In other words, the multiple (four) cartridges P can be sequentially removed from the tray 35 (apparatus main assembly 100A), starting from the most downstream one, in terms of the outward movement of the tray 35, while the tray 35 is moved from the locking-unlocking position D to the mounting-dismounting position E. When the tray 35 is in the mounting-dismounting position E, all the cartridges P can be removed from the tray 35 (apparatus main assembly 100A).

<<Cartridge>>

Figure 7:
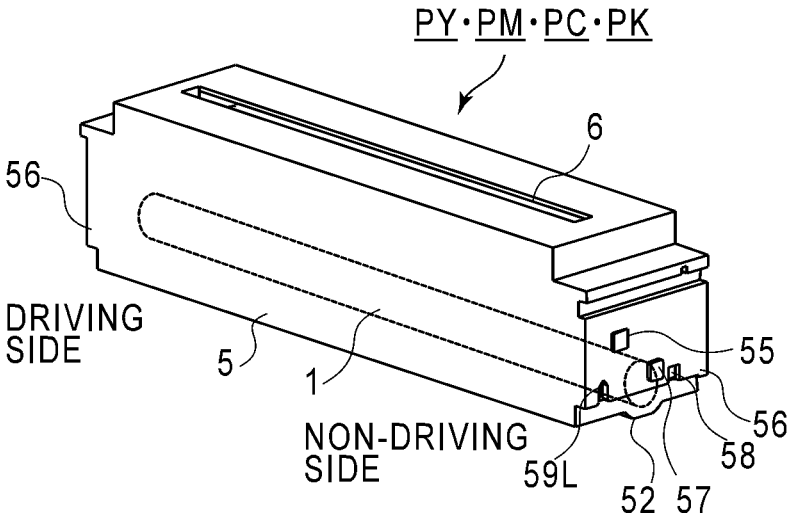
FIG. 7 is a perspective view of a cartridge as seen from a non-driving side.
Figure 8:
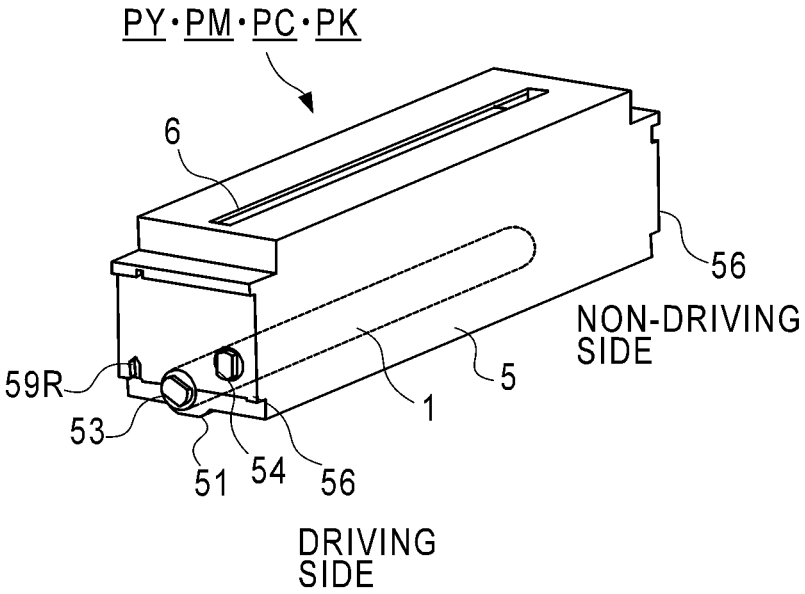
FIG. 8 is a perspective view of the cartridge as seen from a driving side.

FIGS. 7 and 8 are external perspective views of the cartridge P. More specifically, FIG. 7 is a perspective view of the cartridge P as seen from the side from which the cartridge P is not driven, where as FIG. 8 is a perspective view of the cartridge P as seen from the side from which the cartridge P is driven.

The left-right direction of the cartridge P is parallel to the axial line of the drum 1. The cartridge P is an assembly which is roughly in the form of a rectangular parallelepiped. Its lengthwise direction coincides with its left-right direction. The drum 1 is rotatably supported by a pair of bearings 51 and 52, with which the right and left end portions of the cartridge frame 5 are provided. The right bearing 51 is provided with a coupling 53 as a drum driving force input portion (driving force transmitting portion). Further, the right end portion of the cartridge P is provided with a coupling 54 as a developing means driving force input portion (driving force transmitting portion) for driving a development roller 3*a*. It is also provided with a groove 59R, which is for temporarily positioning the cartridge P in terms of the front-rear direction of the apparatus main assembly 100A (tray 35) while the cartridge P is mounted in the tray 35.

The left end portion of the cartridge P is provided with a protrusion 57 for positioning the cartridge P, in terms of the left-right direction, a groove 59L for temporarily positioning the cartridge P in terms of the front-rear direction, an electrical contact 55 (electrical power supply contact point), and a ground contact 58 (contacting member). Each of the left and right end portions of the cartridge P is provided with an eave-like portion created by extending a part of each of the left and right end portions in the left-right direction. Further, the top wall of the cartridge frame 5 is provided with an exposure window 6, which extends in the lengthwise direction of the cartridge P.

The right end of the cartridge P, which is provided with the couplings 53 and 54, is the side from which the cartridge P is driven. The left end portion of the cartridge P, that is, the opposite end portion of the cartridge P from the couplings 53 and 54, which is provided with the electrical contact point 55 is the side from which the cartridge P is not driven. The cartridge P is provided with the pair of couplings 53 and 54, which are at one end (right side) of the cartridge P in terms of the direction perpendicular to the direction in which the tray is allowed to move between the mounting-dismounting position E and locking-unlocking position D after the mounting of the cartridge P in the tray 35, whereas the opposite end (left end) of the cartridge P is provided with the electric power supply contact 55.

<<Tray>>

Figure 9:
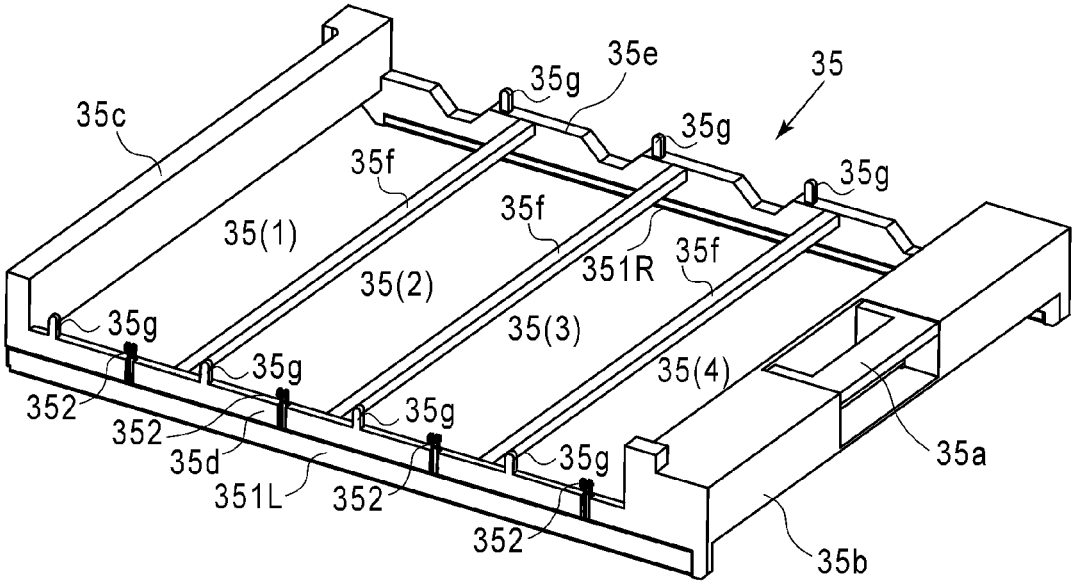
FIG. 9 is a perspective view of the tray.

FIG. 9 is an external perspective view of the tray 35. This tray 35 has a main frame which is rectangular. The internal space of the main frame is provided with four sub-chambers which are created by partitioning the internal space of the main frame with three partitioning plates. The four sub-chambers (first to fourth sub-chambers 35(1)-35(4), listing from the rear sub-frame 35*c* side toward the front sub-frame 35*b* side) are roughly the same in size. These four sub-chambers 35(1)-35(4) are where the first to fourth cartridges PY, PM, PC and PK are held.

Each cartridge P is to be inserted into the corresponding sub-chamber of the tray 35 from above. As the cartridge P is inserted, the slanted surface of its temporarily positioning groove 59L is caught by the arc-shaped tip portion of the temporarily positioning projection 35*g* of the tray 35. Further, the left and right eave-like portions 56 are caught by the top surfaces of the left and right sub-frames 35*d* and 35*e*, by their bottom surfaces, respectively, whereby each cartridge P is supported by the tray 35. That is, the tray 35 supports each cartridge P in such a manner that the cartridge P can be moved out of the tray 35 straight upward. Further, as each cartridge P is moved straight downward toward the tray 35 from above the tray 35, it is supported by the tray 35.

The tray 35 precisely positions each cartridge P by the contact between the slanted portion of the grooves 59L and 59R which are for temporarily positioning the cartridge P, and the arc-shaped portion of the positioning portion 35*g* of the tray 35, which is for temporarily positioning the cartridge P. Further, in terms of the left-right direction (direction of drum axis), the tray 35 loosely holds each cartridge P so that the cartridge P is allowed to move in the left-right direction by an amount equal to the difference between the measurement of the cartridge P in terms of the drum axis direction and the measurement of rectangular sub-chambers 35(1)-35(4) of the tray 35 in terms of the lengthwise direction of the sub-chambers 35(1)-35(4). This structural arrangement can make it easier for each cartridge P to be replaced.

In order to reduce the tray 35 in size, weight, and cost, the tray 35 is made of plastic (ABS, for example) which is relatively less rigid. Further, the tray 35 is structured so that its left and right lateral plates are relatively small in vertical dimension. Regarding the height of the left and right lateral plates of the tray 35, the right lateral plate needs to be low enough to provide the tray 35 with a space for allowing the driving force input portion 53 and 54 to engage with the driving force output portions 39 and 40, respectively, as will be described later. As for the left lateral plate, it needs to be low enough to ensure that the tray 35 is provided with a space for allowing the electrical contact point 55 and the protrusion 57 for positioning a cartridge P in terms of the lengthwise direction to contact the electric power supply system 75 and left sub-frame 80L, respectively. Therefore, it is pertinent that the left and right lateral plates of the tray 35 are structured to be lower, in consideration of the apparatus main assembly structure, in addition to the reduction in the size, weight, and cost of the tray 35.

The material and shape for the tray 35 are chosen for the reasons given above. Therefore, the tray 35 is relatively low in rigidity. Thus, in order to provide the tray 35 with a certain amount of rigidity, the tray 35 is provided with left and right tray reinforcement plates 351L and 351R (reinforcing member to increase tray 35 in strength), which are attached to the bottom portions of the left and right lateral plates, respectively, of the tray 35.

Therefore, even if a user mistakenly applies a substantial amount of force to the tray 35 when the tray is in the mounting-dismounting position E and the user is trying to replace the cartridge P in the tray 35, it is possible to prevent the tray 35 from being damaged. "Applying a substantial amount of force" means that a user applies an unnecessary amount of force to a cartridge P while trying to insert or remove the cartridge P, and/or unintentionally pushes the cartridge P. Further, in the case of this tray structure, it is assumed that the reinforcement plates 351L and 351R are made of steel plate which is roughly 1 mm in thickness. However, the reinforcement plates 351L and 351R may be formed of such plastic that is more rigid than the material for the tray 35.

Incidentally, as the cartridge P is mounted in the tray 35, the ground contact 58 (FIG. 7) of the cartridge P, which is for grounding the drum 1, and the ground contact 352 (electrically conductive member: FIG. 9) of the tray 35, come into contact with each other and establish electrical connection between the cartridge P (drum 1) and tray 35. The electrical current path through which the photosensitive drum 1 is grounded will be described later.

The bottom surfaces of the left and right sub-frames 35*d* and 35*e* of each cartridge P are supported by the top surfaces of the left and right tray supporting members 34L and 34R, with the presence of the reinforcement plates 351L and 351R between the former and latter surfaces, respectively. Thus, not only is the tray 35 supported between the left and right sub-frame 80L and 80R of the main frame of the apparatus main assembly 100A, but also, is allowed to horizontally slide on the top surfaces of the tray holding members 34L and 34R in the front-rear direction of the tray holding members 34L and 34R.

Referring to FIGS. 5 and 6, when a given cartridge P in the tray 35 needs to be replaced, the tray 35 is to be pulled outward of the apparatus main assembly 100A, to the mounting-dismounting position E, and then, the given cartridge P is to be replaced. After the replacement of the given cartridge P, the tray 35 is to be pushed back in the opposite direction from the direction in which the tray 35 was pulled out, all the way into the apparatus main assembly 100A, so that the tray 35 is put in the state in which the tray 35 was before it was pulled out (FIGS. 3 and 4). When the tray 35 is pushed back all the way into the apparatus main assembly 100A as described above, the tray 35 is pushed from behind, by the tray pressing right means 103 (FIG. 15) and the tray pressing left means 105. Thus, it is possible to ensure that the user can guide the tray 35 all the way to the preset inward tray position. This operation will be described later.

Figure 15:
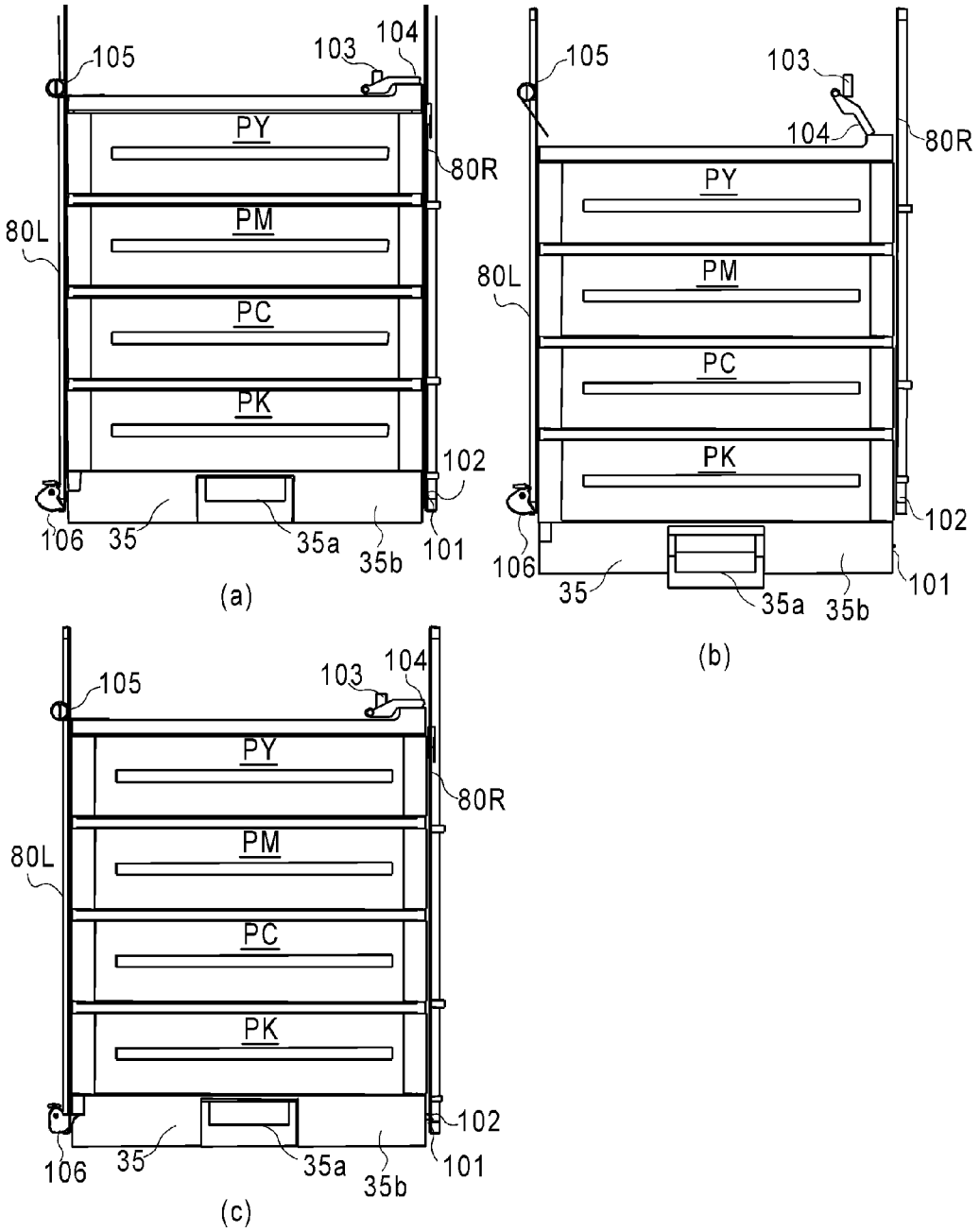
FIG. 15 is a sectional view illustrating the tray position regulating means.

As the tray 35 is pushed back to the preset position (locking-unlocking position D), the ejection prevention pawl 101 (movement regulating means) of the tray 35 engages with the pawl latching portion 102 of the apparatus main assembly 100A (engaging portion on main assembly side) (FIG. 15 (part (b))→15 (part (c))). That is, the tray 35 is pushed back into the apparatus main assembly 100A, from the mounting-dismounting position E to the locking-unlocking position D, and kept in the locking-unlocking position D. The ejection prevention pawl 101 and tray pressing means 103 are positioned roughly the same distance away from the right sub-frame 80R in the direction parallel to the drum axis. Further, the tray pressing means 103 and ejection prevention pawl 101 are positioned on the upstream and downstream sides, respectively, of the tray 35 in a manner to sandwich the reinforcement plate 315R.

As the door 31 is closed, as shown in FIGS. 1 and 2, when it is fully open, the image forming apparatus 100 becomes ready for image formation. That is, as the door 31 is rotationally moved to the closed position A from the open position B, the tray holding members 34L and 34R are moved rearward as well as downward by a preset amount by the rotational closing movement of the door 31, causing the tray 35 to move from the locking-unlocking position D to the image formation position C.

Before the tray holding members 34L and 34R begin to move downward, the left tray movement regulating left means 106 (locking member), that is, one of the pair of tray movement regulating means which are symmetrically positioned relative to the ejection prevention pawl 101, in terms of the left-right direction, which is positioned in the adjacencies of the left sub-frame 80L, is made to protrude by the closing movement of the door 31, and comes into contact with the tray 35. This tray movement regulating means 106 keeps the tray 35, which is being pushed frontward of the apparatus main assembly 100A by the tray pressing left means 105, stationary in the preset position, against the pressure applied by the tray pressing left means 105. Thus, each cartridge P supported by the tray 35 is positioned in its designated position in the cartridge camber 100B in the apparatus main assembly 100A.

The tray pressing means 105 and tray movement regulating means 106 are positioned roughly the same distance away from the sub-frame 80L in terms of the direction parallel to the drum axis, and on the upstream and downstream sides, respectively, of the reinforcement plate 351R, in such a manner that they sandwich the reinforcement plate 351R.

Further, the driving force input portions 53 and 54 of each cartridge P are made to engage with the driving force output portions 39 and 40 of the apparatus main assembly 100A, respectively, by the rotational closing movement of the door 31. During this step, each cartridge is pressed by the driving force output portions 39 and 40 toward (leftward) the lengthwise end of the cartridge P, from which the cartridge P is not driven. Thus, the left-right positioning protrusions 57 come into contact with the left sub-frame 80L. Consequently the cartridge P is precisely positioned in terms of its left-right direction.

Next, each cartridge P is pressed by the pressing member 42 (FIG. 22), and remains fixed in position relative to the tray 35 by the cartridge positioning portion 41 of the tray 35. Further, the electrical contact 55 of each cartridge P comes into contact with the electric power supply system 75 (FIG. 17) of the apparatus main assembly 100A, establishing thereby electrical connection between the cartridge P and apparatus main assembly 100A. The sequential movements of the other components, which are caused by the above described rotational closing movement of the door 31 are described later.

<<Mechanism for Moving Tray Holding Member by Door Movement>>

Next, referring to FIGS. 10-12, 17, 19 and 22, the mechanism for moving the tray holding members 34L and 34R by the rotational movement of the door 31 will be described.

Figure 10:
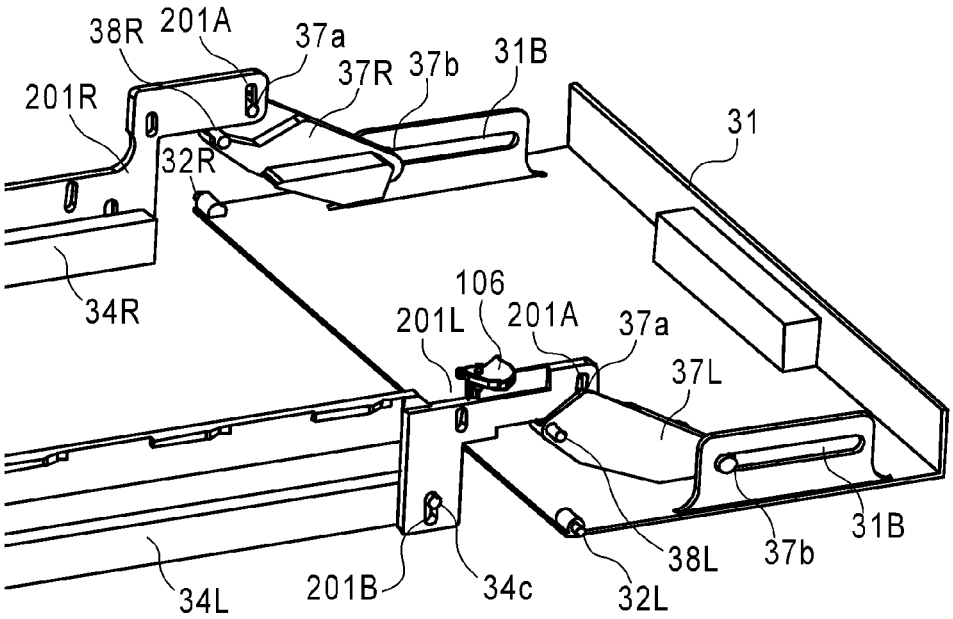
FIG. 10 is a perspective view of an interrelating mechanism portion of a tray holding member.

FIG. 10 is a perspective view of the mechanism for moving the tray holding members 34L and 34R by the movement of the door 31. For the sake of descriptive convenience, the left and right sub-frames 80L and 80R of the apparatus main assembly 100A are not shown in FIG. 10. The hinge portions 31L and 32R of the door 31 are horizontally aligned in the left-right direction relative to the apparatus main assembly 100A. Their left and right end portions are rotatably held by an unshown pair of bearings with which the left and right ends of the apparatus main assembly 100A are provided. They are held between the pair of bearings. The bearings may be integral parts of the left and right sub-frame 80L and 80R.

There are provided a pair of connective arms 37L and 37R in the proximity of the left and right ends of the door 31. The connective arms 37L and 37R are positioned so that their hinge portions 38L and 38R horizontally align relative to the apparatus main assembly 100A in the left-right direction. They are rotatably supported by an unshown pair of bearings with which the left and right ends of the apparatus main assembly 100A are provided. The bearings may be integral parts of the left and right sub-frames 80L and 80R.

There are also provided a pair (left and right) connective rods 201L and 201R on the outward sides of the left and right sub-frames 80L and 80R (FIGS. 17 and 18), respectively. The connective rods 201L and 201R are supported by an unshown pair of guiding members, located on the left and right sides of the apparatus main assembly 100A, so that the connective rods 201L and 201R are movable only in the front-rear direction.

The connective rods 201L and 201R are provided with horizontal shafts 37*a* and 37*b*, respectively. The left connective arm 37L is in engagement with the left connective rod 201L; the horizontal shaft 37*a* of the left connective arm 37L is in the vertical long hole 201A, with which the front end portion of the connective rod 201L is provided. The horizontal shaft 37*b* is fitted in the groove 31B with which the left surface of the door 31 is provided, connecting thereby the left connective arm 37L with left connective rod 201L. Further, the right connective arm 37R is in engagement with the right connective rod 201R; the horizontal shaft 37*a* of the right connective arm 37R is in the vertical long hole 201A, with which the front end portion of the connective rod 201R is provided, connecting thereby the right connective arm 37R with the right connective rod 201R. The horizontal shaft 37*b* is fitted in the groove 31B with which the right surface of the door 31 is provided.

Further, each of the left and right tray holding members 34L and 34R is provided with a pair of pin shafts 34*c* and 34*d*, which are attached to the front and rear portions of the tray holding member 34, with the placement of a preset amount of distance between the pair of pin shafts 34*c* and 34*d*. The pin shafts 34*c* and 34*d* are engaged in a guiding hole 36 (FIG. 11) with which each of the left and right sub-frames 80L and 80R of the apparatus main assembly 100A is provided. With these pin shafts 34*c* and 34*d* being fitted in the corresponding guiding hole 36, the tray holding members 34L and 34R are supported by the left and right sub-frames 80L and 80R, respectively.

The pin shaft 34*c* of the left tray holding member 34L is put through the guiding hole 36, and is engaged in the vertical long hole 201B with which the left connective rod 201L is provided. Although the right tray holding member 34R is unshown, the pin shaft 34*c* of the right tray holding member 34R is put through the guiding hole 36, and is engaged in the vertical long hole 201B with which the right connective rod 201R is provided.

As described above, the door 31 and tray holding members 34L and 34R are in connection with the connective arms 37L and 37R through the connective rods 34L and 34R. Thus, as the door 31 is opened or closed, the left and right tray holding members 34L and 34R are subjected to such force that presses the tray holding members 34L and 34R frontward and rearward, respectively. By the way, the hinge portions 38L and 38R of the connective arms 37L and 37R may be coaxial with the hinge portions 32L and 32R of the door 31. Further, instead of providing the image forming apparatus 100 with the connective arms 37L and 37R, the door 31 may be directly connected to the connective rods 201L and 201R.

Figure 11:
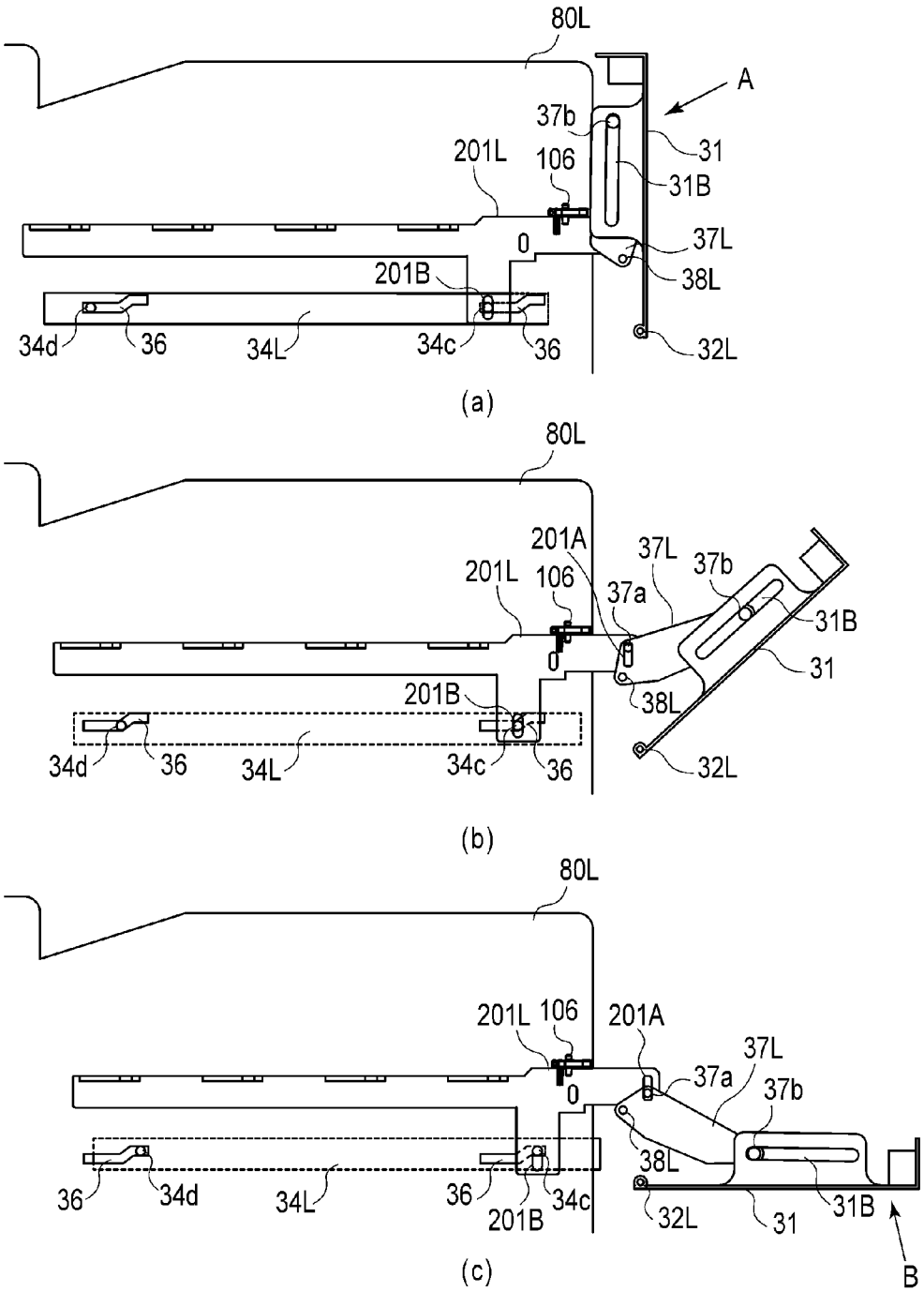
FIG. 11 illustrates movement of the tray holding member interrelated with opening rotation of the door.

FIG. 11 shows the two pin shafts 34*c* and 34*d* and guiding hole 36 of the left tray holding member 34L. Although the right tray holding member 34R is unshown, it is similar to the left tray holding member 34L. Its pin shafts 34*c* and 34*d*, and guiding hole 36, are symmetrical in structure with those of the left tray holding member 34L. Therefore, the left and right tray holding members 34L and 34R are afforded a certain amount of latitude in terms of their movement within the guiding range of the guiding hole 36.

Figure 12:
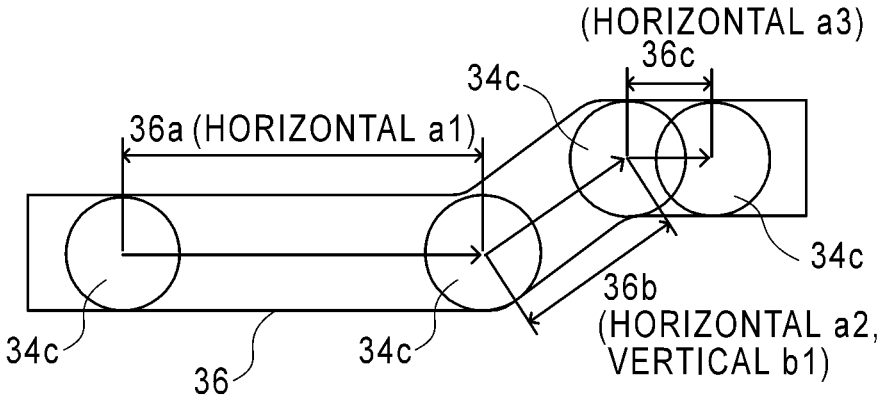
FIG. 12 is an enlarged view of a guiding hole portion of the tray holding member.

FIG. 12 is an enlarged view of the guiding hole 36 portion of the tray holding member 34. Both guiding holes 36 have: a first guiding portion 36*a*, which is horizontal and extends in the front-rear direction; a second guiding portion 36*b*, which is upwardly slanted rearward from the first guiding portion 36*a*; and a third guiding portion 36*c*, which horizontally extends rearward from the top end of the second guiding portion 36*b*, catches the pin shafts 34*c* and 34*d*, and reliably holds the pin shaft 34*c* and 34*d*.

As the door 31 is rotatably opened, the pin shafts 34*c* and 34*d*, which are parts of each of the left and right tray holding members 34L and 34R, are moved by the rotational opening movement of the door 31 in the following manner. That is, first, they are horizontally moved (guided) by the first guiding portion 36*a* by a distance a1. Then, they are moved (guided) diagonally upward (horizontally by distance a2 and vertically by distance a3) by the second guiding portion 36*b*.

FIG. 11 (part (a)) shows the state of the tray 35, door 31, etc., of the apparatus main assembly 100A, in which the door 31 is in the closed position A, keeping thereby the apparatus main assembly 100A (opening 30) completely closed. When the door 31 is in the position shown in FIG.

11 (part (a)), the left and right tray holding members 34L and 34R are in their rearmost positions in the apparatus main assembly 100A, to which they were moved by the coordination between the connective arms 37L and 37R and connective rods 34L and 34R. The pin shafts 34*c* and 34*d* are in the rear portion of the first guiding portion of the guiding hole 36.

Therefore, the left and right tray holding members 34L and 34R are in the preset bottommost position (second position) relative to the left and right sub-frames 80L and 80R, respectively. Therefore, the tray 35 held by the tray holding members 34L and 34R is also in its preset bottommost position, that is, the image formation position C (FIG. 2).

Referring to FIG. 15 (part (a)), when the tray 35 is in the position shown in FIG. 11 (part (a)), it is under the pressure applied from the rear end portion by the tray pressing right means 104, near the right lateral plate of the tray 35, and the ejection prevention pawl 101 is in engagement with the pawl latching portion 102 of the apparatus main assembly 100A, with which the sub-frame 80R of the apparatus main assembly 100A is provided, on the front side of the tray 31. Further, in the adjacencies of the left lateral plate of the tray 31, the tray 31 is under the pressure generated from the rearward side by the tray pressing left means 105, whereas on the front side, the tray movement regulating left means 106 is in engagement with the tray 31. In other words, the tray 35 is remaining precisely positioned relative to the apparatus main assembly 100A from both the left and right sides.

Further, the portions of the tray 31, which come under the pressure from the positioning members, and the portions of the tray 31, by which the tray 31 is positioned, are located near the lateral plates of the tray 31, which are provided with such an amount of rigidity that is enough to prevent the portions from buckling, by the reinforcement plates 351L and 351R. Thus, the tray 31 is unlikely to be bent (buckled). That is, the tray 31 can be precisely position in its preset position, without being deformed. In other words, the tray 31 can be reliably positioned in terms of the front-rear direction.

As the tray 35 is held in the image forming position C, each of the cartridges PY, PM, PC and PK held by the tray 35 is in its designated image formation position in the cartridge storage chamber 100B. The left and top right end portions of the top surface of each cartridge P are under the pressure from the pressing member 42 (FIG. 22). Thus, the bottom portion of the bearing 51 on the drive side, and the bottom portion of the bearing 52 on the non-drive side, are pressed into the positioning portions (FIGS. 13, 17 and 22), with which the left and right positioning members 81L and 81R are provided. Thus, each cartridge P becomes fixed in position.

Further, the rotation prevention groove 561 (FIG. 22) with which each cartridge P is provided engages with the rotation prevention pin 801 (FIGS. 13, 14, 17, 19 and 22) crimped to the lateral plate 80, preventing thereby the cartridge P from rotationally moving about the axial lines of the bearings 51 and 52. That is, each cartridge P is made to remain in its preset position and attitude, in the apparatus main assembly 100A.

Figure 22:
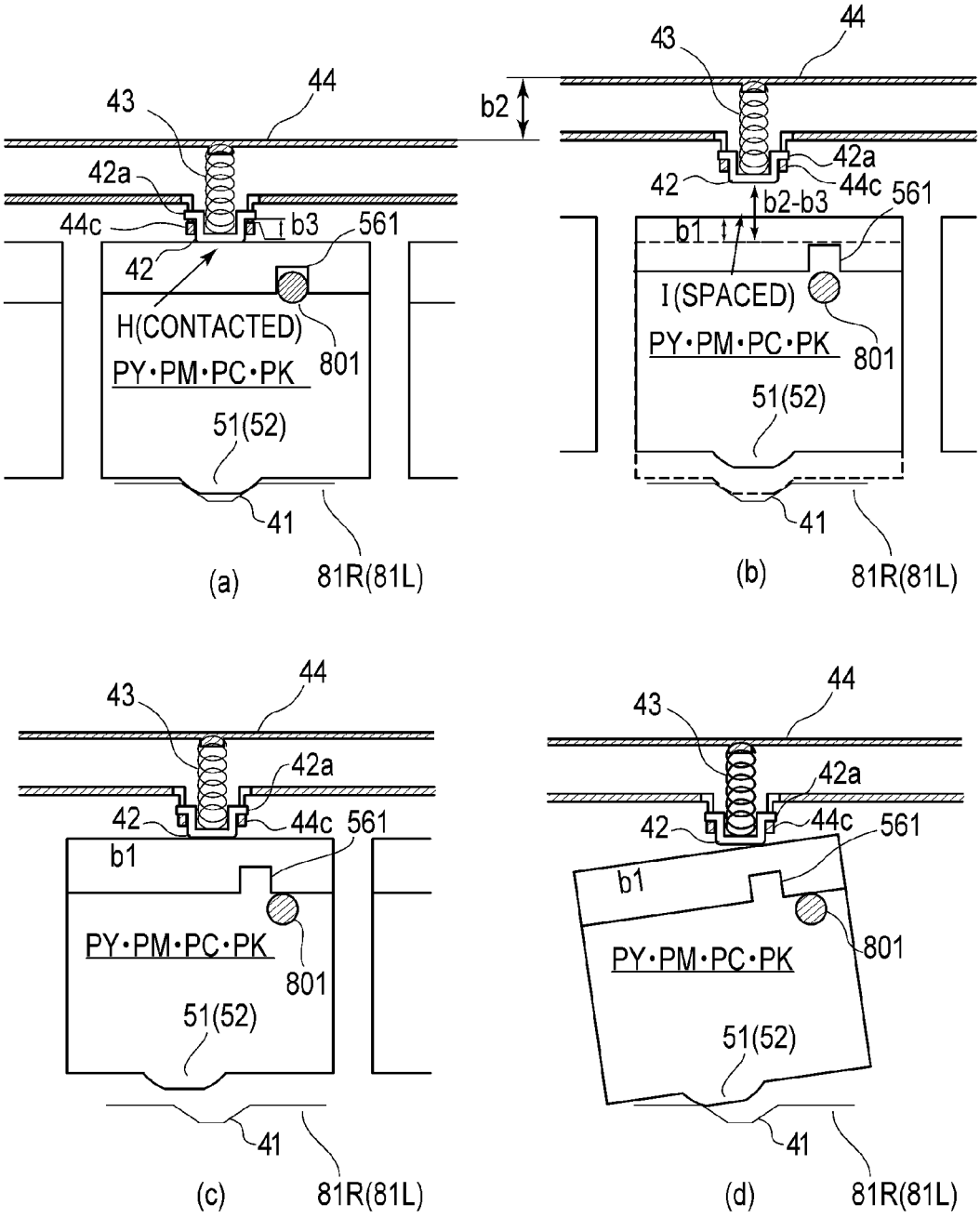
FIG. 22 is an illustration of the means for urging the cartridge.

Referring to FIGS. 22 (part (c)) and 22 (part (d)), if the tray 35 remains loose relative to the apparatus main assembly 100A in terms of the front-rear direction, or remains deformed by the force applied thereto by the pressing means 104 and 105, or the like, the bearings 51 and 52 fail to fit into the positioning portions 41, and/or the rotation prevention groove 561 and rotation prevention pin 801 fail to engage with each other, making it impossible for the cartridge P to remain in the preset position. Therefore, it becomes impossible for the image forming apparatus 100 to output images. This is why the tray 35 has to be precisely positioned by the contact between its rigid portions and the positioning portions of the apparatus main assembly 100A, as described above.

When the image forming apparatus 100 and each cartridge P are in the state described above, it is ensured that the downwardly facing portion of the peripheral surface of the drum 1 remains in contact with the top surface of the top portion of the belt 13, in terms of the loop which the belt 13 forms (FIG. 2). Also in this state, the couplings 53 and 54 of each cartridge P are in engagement with the drum driving coupling 39 and developing means driving coupling 40 of the apparatus main assembly 100A, respectively. Further, the electrical contact 55 of each cartridge P is in the state in which it can receive electric power from the apparatus main assembly 100A.

FIG. 11 (part (b)) shows the state of the door 31, tray 35, etc., of the apparatus main assembly 100A, in which the door 13 is open halfway. As the door 31 which is in the state shown in FIG. 11 (part (a)) is opened, the left and right tray holding members 34L and 34R are pulled frontward by the movement of the door 31. Thus, the tray holding members 34L and 34R are guided by the first guiding portion 36*a* of the guiding hole 36. First, therefore, the tray 35 horizontally moves frontward by the distance a1. FIG. 11 (part (b)) shows the state of the door 31, tray 35, etc., of the apparatus main assembly 100A and door 31 right after the pin shafts 34*c* and 34*d* have been moved frontward by the distance a1.

While the tray holding members 34L and 34R are moved by the distance a1, first, the electrical connection between the electrical contact point 55 of each cartridge P and the electrical power supply system 75 of the apparatus main assembly 100A is broken. Then, the pressing member 42 stops keeping each cartridge P precisely positioned. Moreover, the drum driving coupling 39 and developing means driving coupling 40 become disengaged from the cartridge P. On the right side of the apparatus main assembly 100A, however, the ejection prevention pawl 101 becomes engaged with the pawl latching portion 102 of the apparatus main assembly 100A, preventing thereby the tray 35 from following the movement of the tray holding members 34L and 34R. On the left side of the apparatus main assembly 100A, the tray 35 has come into contact with the tray movement regulating means 106, being thereby precisely positioned.

As the door 31 is rotatably moved further, the tray holding members 34L and 34R are further pulled frontward by the movement of the door 35. Thus, the pin shafts 34*c* and 34*d* of the tray holding members 34L and 34R are guided by the second guiding portion 36*b* of the guiding hole 36. Therefore, the pin shafts 34*c* and 34*d* (tray 31) are moved diagonally upward. During this movement of the tray 35, the tray 35 remains fixed in position in terms of the front-rear direction. Therefore, it does not occur that the tray 35 moves in the horizontal direction. The tray 35 follows only the vertical movement of the tray holding members 34L and 34R, causing the drum 1, which the cartridge P has, to separate from the belt 13 of the apparatus main assembly 100A (FIG. 4).

FIG. 11 (part (c)) shows the state of the door 31, tray, 35, etc., of the apparatus main assembly 100A, in which the door 31 is fully open. When the apparatus main assembly 100A and door 35 are in the state shown in FIG. 11 (part (c)), the tray holding members 34L and 34R have finished their diagonally upward movement caused by the second guiding portion 36*b*, and the pin shafts 34*c* and 34*d* are in the third guiding portion 36*c*, which is horizontal. That is, the tray holding members 34L and 34R are horizontally moved after being moved diagonally upward.

The reason for the above described structural arrangement is for keeping each cartridge P and tray holding members 34L and 34R stabilized in position in terms of the vertical direction when replacing the cartridge P after the tray 35 is pulled out of the tray holding members 34L and 34R, and also, for preventing the tray holding members 34L and 34R from returning to where they were.

Further, during the transition from FIG. 11 (part (b)) to FIG. 11 (part (c)), the tray holding members 34L and 34R finish moving diagonally upward, and the pin shafts 34*c* and 34*d* slide in the third guiding portion 36*c*, which is horizontal. While the pin shafts 34*c* and 34*d* are sliding in the third guiding portion 36*c*, the tray movement regulating means 106 retracts outward of the lateral plate 80L, ceasing to regulate the tray 35 in position, on the left side of the tray 35.

The tray holding members 34L and 34R horizontally move after they are moved diagonally upward as described above. Therefore, they are held in the top position (first position) which is a preset distance upward of the left and right sub-frames 80L and 80R, respectively. Thus, the tray 35, which is held by the tray holding members 34L and 34R, is also held in a preset tray position. That is, the tray 35 is changed in position from the image formation position C (FIG. 2) to the locking-unlocking position D (FIG. 4), and held there.

While the tray 35 is in the above described state, it is free from the pressure applied by the tray regulating members. Therefore, it is possible for the tray 35 to be slid in the front-rear direction relative to the tray holding members 34L and 34R. Thus, it is possible for the tray 35 to be slid between the cartridge mounting-dismounting position E, and the locking-unlocking position D.

While the tray 35 is pulled out of the apparatus main assembly 100A, the positioning protrusion 57 which keeps the cartridge P on the tray 35 precisely positioned in terms of the left-right direction horizontally slides on the inward side of the left sub-frame 80L. Therefore, it is desired that the area of the left sub-frame 80L, which corresponds in position to the path of the positioning protrusion 57, is flat and free of holes, grooves, and protrusions.

That is, by not positioning the holes which the left sub-frame 80L is required to have, in the area of the left sub-frame 80L, which corresponds to the path of the positioning protrusion 57, it is possible to prevent the positioning protrusion 57 from being scarred and/or shaved, in order to ensure that the tray 35 can be smoothly pulled out. Here, "holes" means the hole through which the electrical contact spring 75 (FIG. 17), guiding hole 36 of the tray holding members 34, and the like.

Figure 17:
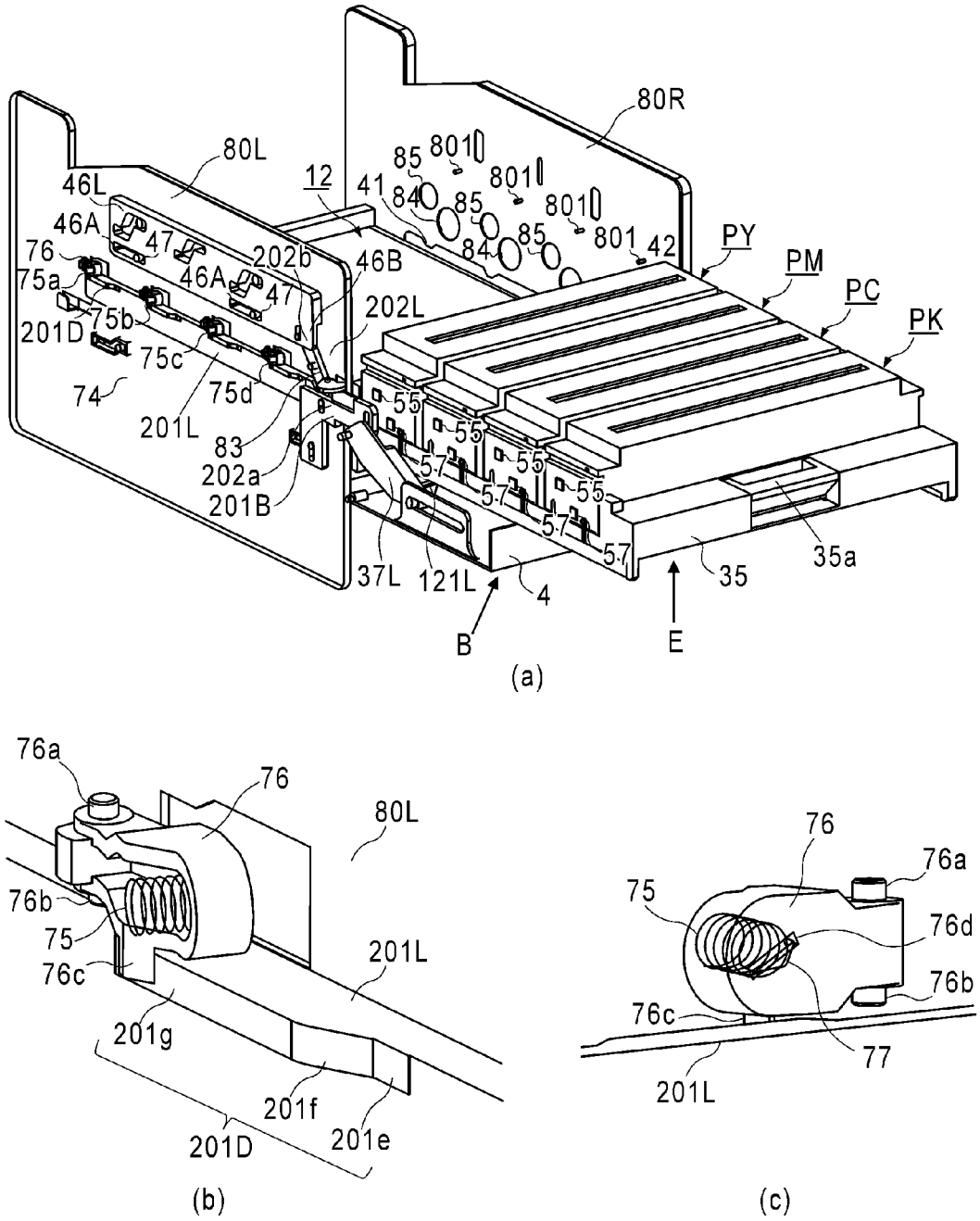
FIG. 17 is an illustration of a means for electric energy supply to the cartridge.
Figure 19:
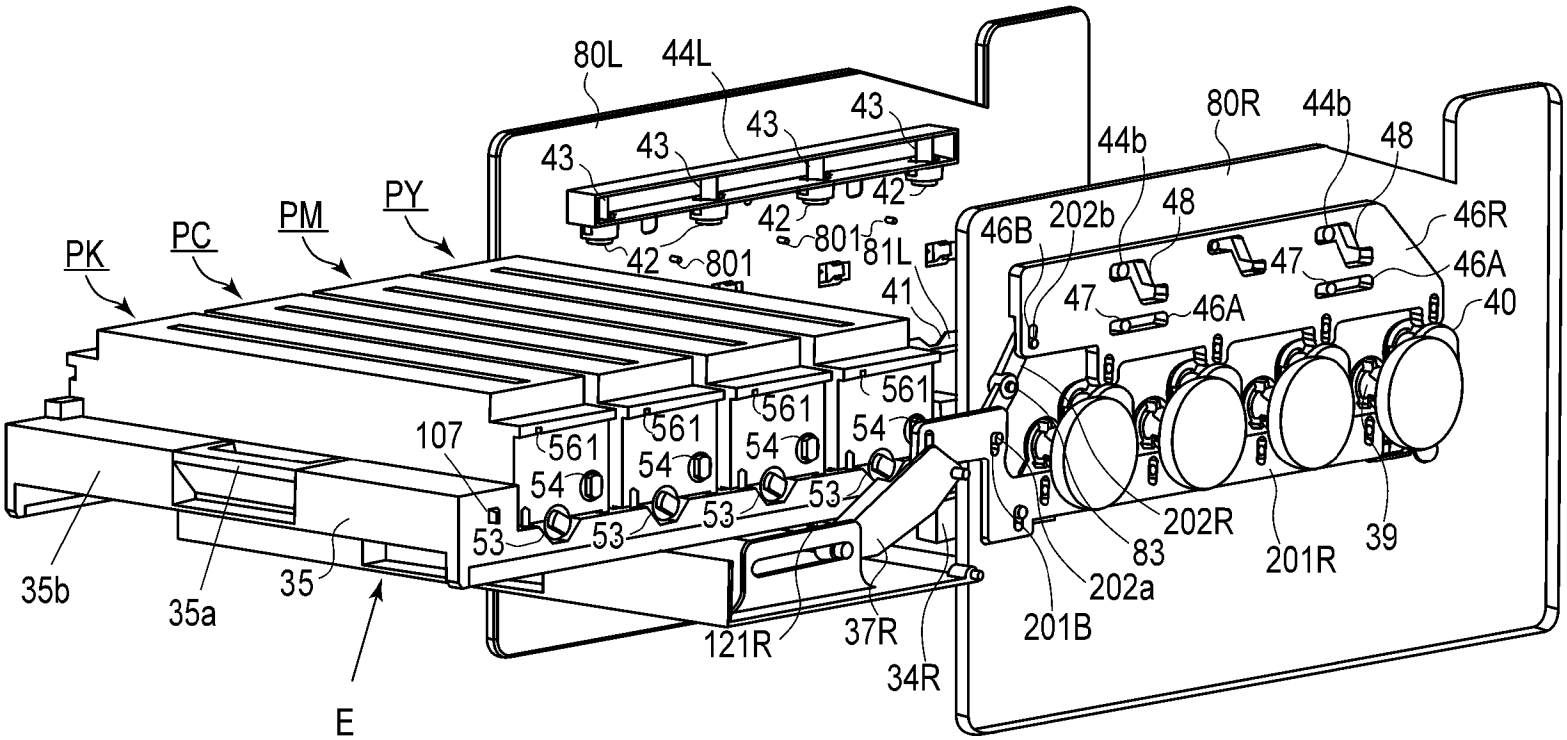
FIG. 19 is a perspective view illustrating a means for urging the cartridge.

FIGS. 17 and 19 are perspective views of a combination of the apparatus main assembly 100A, cartridges P, tray 35, etc., when the tray 35 is in the mounting-dismounting position E in which the cartridges P can be mounted into, or dismounted from, the tray 35. When the combination is in the state shown in FIGS. 17 and 19, the tray 35, which is almost entirely out of the apparatus main assembly 100A, is held by the tray supporting portions 121L and 121R of the connective arms 37L and 37R, respectively. Therefore, it does not occur that the portion of the tray 35, which is extending from the front side of the apparatus main assembly 100A, is made to downwardly deform by the combination of the weight of the cartridges and the weight of the tray 35. Therefore, it does not occur that the surface of the drum 1 is scarred by the above described downward deformation of the portion of the tray 35 extending from the apparatus main assembly 100A. Further, it is possible to prevent the accident that as the tray 35 is pulled out of the apparatus main assembly 100A, the apparatus main assembly 100A becomes unbalanced in terms of weight distribution, and causes the apparatus main assembly 100A to tilt frontward.

The connective arms 37L and 37R are rotationally moved by the movement of the door 31. Therefore, the apparatus main assembly 100A is designed (structured) so that when the door 31 is completely closed, the tray supporting portions 121L and 121R of the connective arms 37L and 37R remain in the apparatus main assembly 100A, whereas the door 31 is fully open, they remain outside the apparatus main assembly 100A. Thus, it is possible to reliably hold the tray 35 in the mounting-dismounting position E. Therefore, the image forming apparatus 100 can be improved in usability, without increasing the apparatus main assembly 100A in size.

By the way, the shape and number of cartridge supporting points of the tray supporting portions 121L and 121R which support the tray 35 when they are in the mounting-dismounting position E do not need to be as shown in FIGS. 17 and 19. Further, the tray supporting portions (portions which support tray 35 when tray 35 is in mounting-dismounting position E) may be formed as integral parts of the door 31.

<<Tray Position Regulating Means>>

Figure 13:
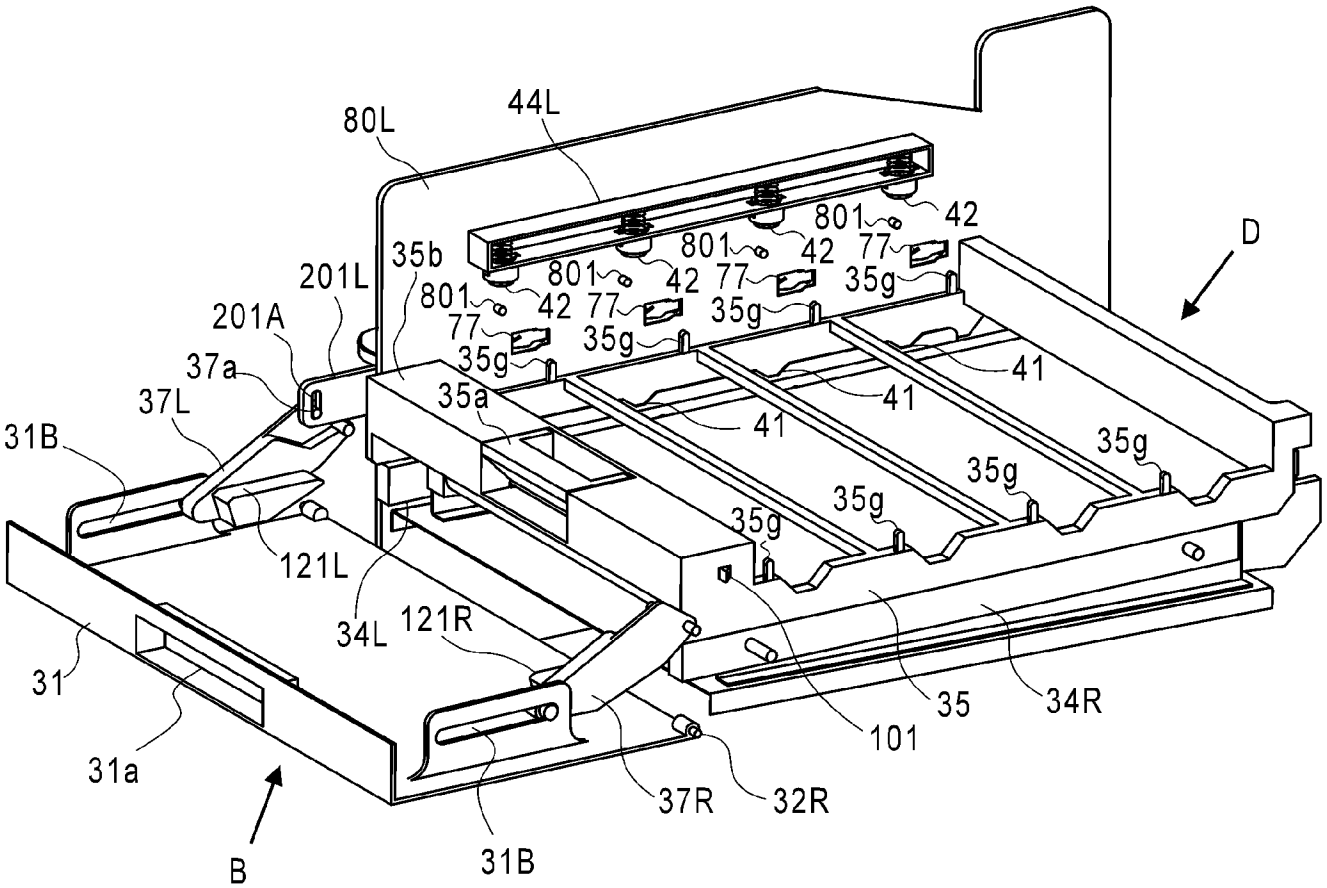
FIG. 13 is a perspective view illustrating a tray position regulating means (limiting means).
Figure 14:
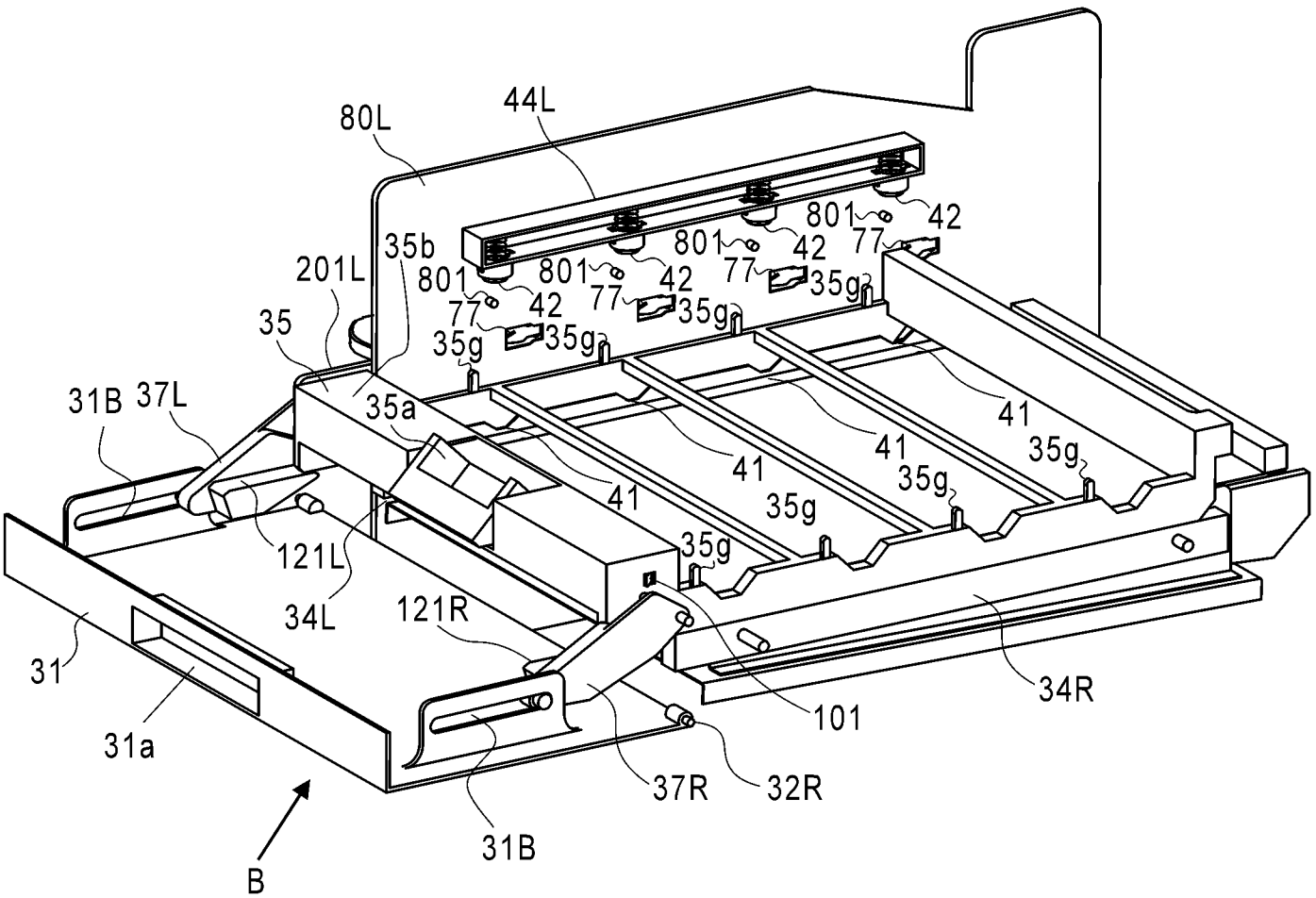
FIG. 14 is a perspective view illustrating a tray position regulating means.

Next, referring to FIGS. 13-16, and 26, the tray position regulating means is described. FIG. 13 is a drawing for showing the state of the combination of the door 31, tray 35, left sub-frame 80L, etc., after the tray 35 was moved from the mounting-dismounting position E, which is outside the apparatus main assembly 100A, to the locking-unlocking position D (FIG. 4), which is in the apparatus main assembly 100A. FIG. 14 is a drawing for showing the state of the combination before the tray 35 has been moved almost to the locking-unlocking position D. FIG. 15 is a drawing for describing the operation of the movement regulating means which guides the tray 35 to ensure that the tray 35 is moved into the locking-unlocking position D.

Figure 16:
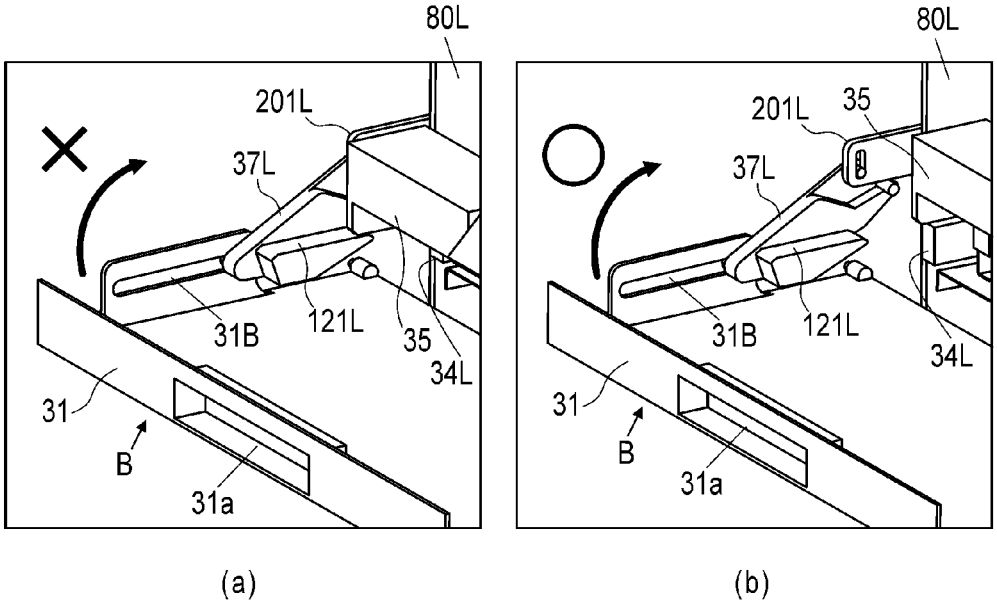
FIG. 16 is a perspective view illustrating a tray position regulating means.

If the door 31 is closed when the tray 35 is in the state shown in FIG. 14, that is, when the tray 35 has not been fully pushed into the apparatus main assembly 100A, the tray supporting portions 121L and 121R of the connective arms 37L and 37R collides with the bottom surface of the tray 35, as shown in FIG. 16 (part (a)), while the connective arms 37L and 37R are rotated by the rotational closing movement of the door 31. Therefore, it is impossible to close the door 31 to move the tray holding members 34L and 34R rearward of the apparatus main assembly 100A to lower the tray holding members 34L and 34R.

In comparison, when the tray 35 is in the state shown in FIG. 13, that is, after the tray 35 was completely pushed into the apparatus main assembly 100A, the tray supporting portions 121L and 121R of the connective arms 37L and 37R do not interfere with the tray 35, as shown in FIG. 16 (part (b)), while the connective arms 37L and 37R are rotationally moved by the rotational closing movement of the door 31. Therefore, it is possible to close the door 31 to move the tray holding members 34L and 34R and tray 35 downward.

Referring to FIG. 15, the right-rear corner of the tray 35 is under the pressure applied thereto by the spring 103 through the pressing member 104. That is, the left side of the tray 35 is under the pressure delivered by the tray pressing means 105. Therefore, if a user fails to push the tray 35 all the way into the apparatus main assembly 100A, the spring 103 and tray pressing means 105 remain protrusive by no less than a preset amount which is proportional to the stroke of the tray pressing means 105, as shown in FIG. 15 (part (b)). When the spring 103 and tray pressing means 105 are in the state shown in FIG. 15 (part (b)), the position of the tray 35 is as shown in FIGS. 14 and 16 (part (a)).

Therefore, if a user tries to mistakenly close the door 31, that is, without moving the tray 35 all the way to the tray locking-unlocking position D, the tray supporting portions 121L and 121R of the connective arms 37L and 37R never fail to interfere with the tray 35, ensuring that the user is prompted to correct the mistake.

In comparison, when the tray 35 is in the state shown in FIGS. 13 and 16, that is, after the tray 35 was pushed into the apparatus main assembly 100A all the way to the tray locking-unlocking position D, the ejection prevention pawl 101 is in engagement with the pawl latching means 102 of the apparatus main assembly 100A. Therefore, it is possible for the tray 35 to be held in the apparatus main assembly 100A as shown in FIG. 15 (part (a)). At this point in time, the right side of the tray 35, that is, the side having the ejection prevention pawl 101, remains precisely positioned. However, the opposite side (left side) is under the pressure applied by the tray pressing means 105 from the rear side. Therefore, it is possible that the left side of the tray 35 will have positional errors attributable to deformation of the abovementioned components, and/or tolerance in measurement of the components.

A user is to close the front door 31 after the user placed the tray 35 in the tray locking-unlocking position D. As the user closes the door 31, the connective rod 201L is slid in the front-rear direction by the closing movement of the door 31. As the connective rod 201L is slid in the front-rear direction, the connective rod 201L comes into contact with the end portion of the tray movement regulating means 106, causing thereby the tray movement regulating means 106 to rotationally move until the tray movement regulating means 106 is rotated into a preset position, in which it regulates in position the tray 35, which is under the pressure applied by the tray pressing means 105. Therefore, it is possible to precisely position the left side of the tray 35 by overcoming the possibility that the tray 35 will be erroneously positioned because of the insufficiency in the strength of the tray 35, tolerance in measurement of the components, etc.

As the door 31 is closed further, the tray holding members 34L and 34R move downward, and therefore, the tray 35, and the cartridges P on the tray 35, also move downward. Thus, the bearings 51 and 52 of each cartridge P are held by the positioning portions 41, and the rotation prevention groove 561 engages with the rotation prevention pin 801. Consequently, each cartridge P is precisely positioned relative to the apparatus main assembly 100A as shown in FIG. 22 (part (a)).

Since both the left and right sides of the tray 35 are precisely positioned relative to the apparatus main assembly 100A as described above, neither the left nor right side of the cartridge P becomes disengaged from any of the positioning mechanism, and therefore, the cartridge P is set in its normal position as shown in FIG. 22 (part (a)).

Next, the rigidity of the tray 35, portions of tray 35 which come under pressure, and portions of the tray 35 by which tray 35 is regulated in position, are described. There is at least one pressing means (pressure applying member) which is made up of pressing members 104 and 105 and presses the tray 35 in the direction in which it is pulled outward from the tray the locking-unlocking position D, on the upstream side of the ejection prevention pawl 101 in terms of the direction in which the tray 35 is pulled out of the apparatus main assembly 100A. The combination of the pressing means 104 and 105 can apply to the tray 35 such an amount of rotational pressure (force) that when the ejection prevention pawl 101 is in its regulating position Q, the combination of the forces generated by the pressing means 104 and 105 causes the tray 35 to protrude by a certain amount downward from the apparatus main assembly 100A, in terms of the direction in which the tray 35 is to be pulled out.

If the image forming apparatus 100 is structured so that the tray pressing means 104 presses on the center portion of the tray 35 in terms of the left-right direction, the center portion of the rear sub-frame 35*c* of the tray 35, or the center portion of the partitioning plate 35, bears the load. Thus, it is possible that the tray 35 will be deformed, and therefore, the cartridges P will be made to deviate in position.

Therefore, it is desired that the tray pressing means 105 are positioned near the left and right end portions of the tray 35. Further, the tray 35 is pulled out of the apparatus main assembly 100A or pushed back into the apparatus main assembly 100A. Therefore, the portion of the rear end of the apparatus main assembly 100A, which is outside the tray path (inward and outward), is greater in latitude in terms of the positioning of the tray pressing means 104. Thus, it is desired that the tray pressing means 104 is positioned near the rear end of the apparatus main assembly 100A. Similarly, regarding the positioning of the ejection prevention pawl 101, which regulates the tray 35 in position, in terms of the left-right direction, it is desired that the ejection prevention pawl 101 is positioned so that it will be in the adjacencies of the left and right ends of the tray 35 when the tray 35 is in the apparatus main assembly 100A. From the standpoint of minimizing in size the area in which the ejection prevention pawl 101 rubs against the lateral plates 80, etc., when the tray 35 is pulled out of, or pushed into, the apparatus main assembly 100A, it is desired that the ejection prevention pawl 101 is positioned at the front end of the apparatus main assembly 100A, in terms of the front-rear direction.

On the other hand, the attempt to reduce the tray 35 in size, weight, and cost has reduced the tray 35 in rigidity. Thus, the tray 35 is provided with the reinforcement plates 351L and 351R, which are attached to the bottom portions of the left and right lateral plates of the tray 35. As described above, the left and right tray pressing means 104 and 105 are positioned so that when the tray 35 is entirely in the apparatus main assembly 100A, they will be near the end portions of the left and right lateral plates of the tray 35, and the ejection prevention pawl 101 and tray movement regulating means 106 are positioned so that when the tray 35 is entirely in the apparatus main assembly 100A, they will be at the front ends of the tray 35. Therefore, the force (pressure) which these components place upon the tray 35 is caught by the metallic plates. Therefore, the tray 35 is prevented from deforming (buckling).

Further, the position regulating members 101 and 106 and pressing members 104 and 105 are disposed so that they will be at the left and right ends of the tray 35 when the tray 35 is in the apparatus main assembly 100A. Therefore, the left and right sides of the tray 35 can be precisely positioned independently from each other. Therefore, it is possible to precisely position the tray 35 relative to the apparatus main assembly 100A, without taking into consideration the positional deviation between the left and right sides of the tray 35 attributable to the tolerance in terms of component dimension, and deformation.

Next, the tray positioning left and right means are described about their structure. If a pair of ejection prevention pawls 101 are used as both the means for precisely positioning the left and right sides of the tray 35, it is possible that the tolerance in the dimension of components, warping of the tray 35, etc., will cause only one of the ejection prevention pawls 101 to engage with the corresponding pawl latching means 102 (other pawl does not).

If the image forming apparatus 100 is in the above described state, it is possible that the amount by which the tray 35 is made to protrude from the apparatus main assembly 100A by the tray positioning means will be insufficient. Therefore, it is possible that even through the tray 35 is in the preset position, the tray 35 and connective arm 37 will not interfere with each other, as shown in FIG. 16 (part (b)). Therefore, it is possible that the door 31 can be closed. Therefore, it is possible that the cartridges P will fail to be set in the normal positions, and therefore, it will be impossible for the image forming apparatus 100 to perform an image forming operation.

Further, if a pair of tray movement regulating means 106 are used as the means for precisely positioning both the left and right sides of the tray 35, the tray 35 is not going to be locked in the tray locking-unlocking position D even after a user pushed the tray 35 into the locking-unlocking position D. Therefore, the tray 35 has to be manually held by the user until the tray movement regulating means 106 arrives at the position in which it supports the tray 35. Therefore, this arrangement is undesirable from the standpoint of usability.

Therefore, it is desired that the means for positioning the tray 35 has a mechanical structure such as the above described one. That is, it is desired that one side is made up of a component such as the ejection prevention pawl 101 which latches on the tray 35 as the tray 35 is pushed into, or pulled out of, the apparatus main assembly 100A by a user, whereas the other side, which latches onto the tray 35 after the tray 35 was latched on one side of the tray 35, is made up of a component such as the tray movement regulating means 106.

By the way, in this embodiment, the tray 35 was provided with the ejection prevention pawl 101, and the apparatus main assembly 100A was provided with the pawl latching portion 102. However, the image forming apparatus 100 may be structured so that ejection prevention pawl 101 protrudes from the apparatus main assembly 100A, and the tray 35 is provided with the pawl latching portion. Also in this embodiment, the image forming apparatus 100 is structured so that the tray movement regulating means 106 is moved by the movement of the door 31. However, the image forming apparatus 100 may be structured so that the tray 35 is locked in position by the tray movement regulating means 106 actuated as it is detected that the tray 35 has been properly set. Moreover, the number and shape of the ejection prevention pawl 101 and pawl latching portion 102 do not need to be the same as those in this embodiment.

Figure 27:
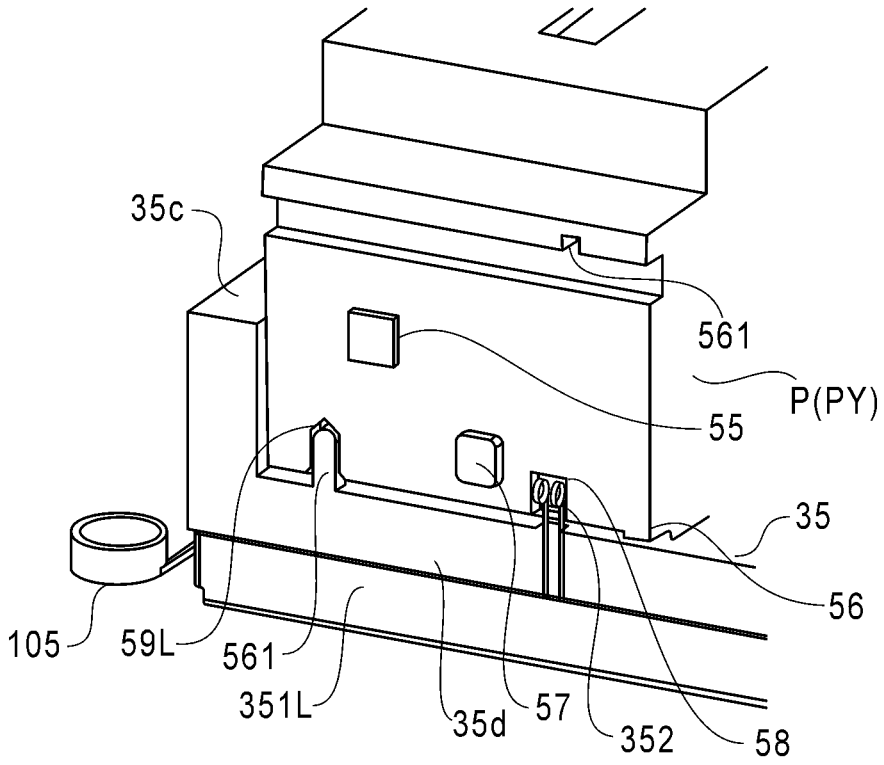
FIG. 27 illustrates a conduction path from a left-hand tray urging means to the cartridge.

Next, the electrical path through which the drum 1 is grounded is described. FIG. 27 is a drawing for showing the electrical connection between the left tray pressing means 105 and the cartridge grounding contact 58. As a cartridge P is set in the tray 35, the grounding contact 58 (contacting member) of the cartridge P comes into contact with the tray grounding contact 352 (electrically conductive member), and therefore, electrical connection is established between the cartridge P and tray 35. The tray grounding contact 352 is always in contact with the reinforcement plate 351L, which is made of steel plate, being therefore electrically conductive. Thus, there is always electrical connection between the tray grounding contact 352 and reinforcement plate 351L.

As the tray 35 set in the apparatus main assembly 100A is moved into the tray locking-unlocking position D, the tray 35 comes into contact with the tray pressing means 105 which is an electrically conductive coil spring made of steel wire. Thus, electrical connection is established between the tray 35 and tray pressing means 105. There is always electrical connection between the tray pressing means 105 and lateral plate 80L. The reinforcement plate 351L is long (wide) enough to prevent the problem that as the tray 35 is moved from the tray locking-unlocking position D to the image formation position C, it becomes disengaged from the tray pressing means 105. This is how the cartridge P is grounded.

That is, in this embodiment, the coil spring 105 which is a pressure applying member is electrically conductive. The tray 35 is provided with a tray grounding contact 352, which is an electrically conductive member and contacts the electrically conductive coil spring 105 when the tray 35 is in the locking-unlocking position D. Thus, as a cartridge P is placed in the tray 35, this tray grounding contact 352 comes into contact with the cartridge grounding contact 58 with which the cartridge P is provided, establishing thereby electrical connection between the tray 35 and cartridge P. The reinforcement plate 351L which is electrically conductive, doubles as the above described electrically conductive member.

Here, in this embodiment, the reinforcement plate 351L was utilized as a part of the drum grounding path. However, in a case where the reinforcement plates 351L is made of an electrically nonconductive substance, electrical connection may be established between the tray grounding contact 352 and pressing means 105 by providing the reinforcement plate 351L with an electrically conductive component, such as a piece of steel wire, to provide the reinforcement plate 351L with an electrically conductive path.

Figure 26:
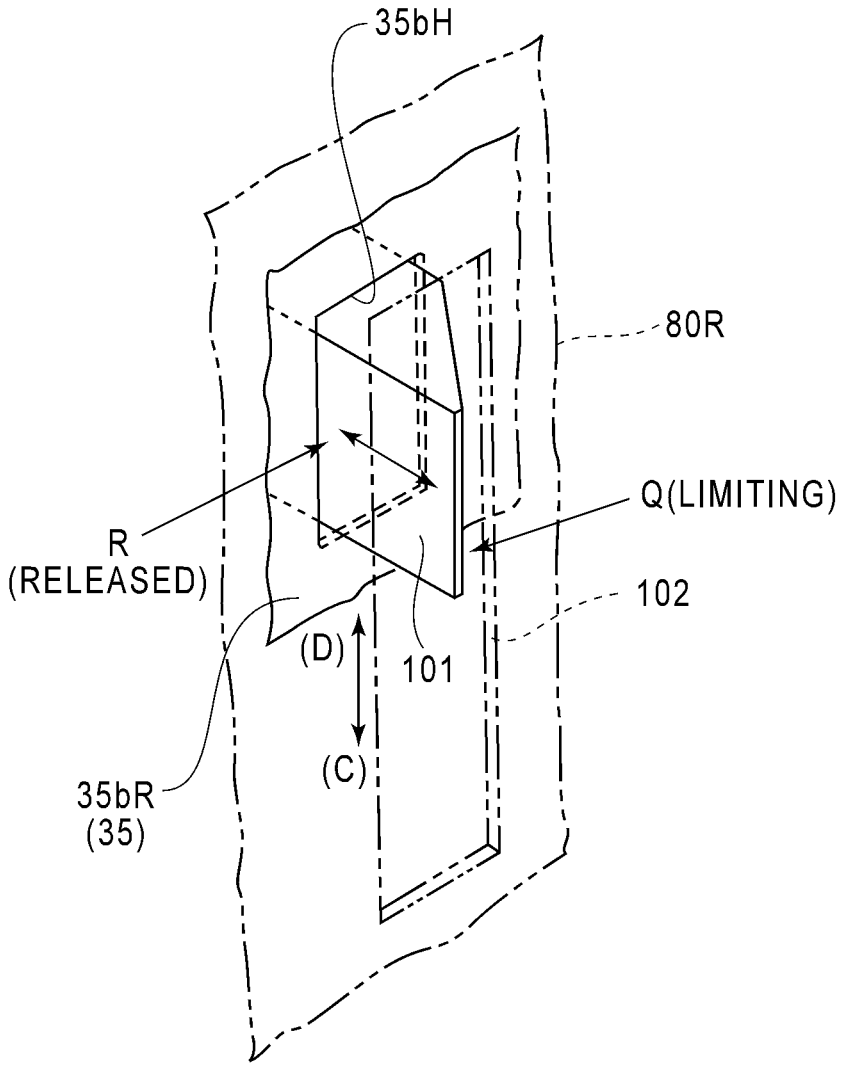
FIG. 26 illustrates a pop out prevention claw and a main assembly side engaging means.

FIG. 26 shows the shape of the ejection prevention pawl 101 and pawl engaging means 102 in this embodiment. The ejection prevention pawl 101 is a pawl which is made to protrude from, or retract into, the tray 35, through the hole 35*b*H with which the right surface 35*b*R of the front sub-frame 35*b* of the tray 35 is provided, by the movement of the moveable handle 35*a*. The pawl engaging means 102 of the apparatus main assembly 100A is a vertical long hole with which the right sub-frame 80R of the apparatus main assembly 100A is provided. As the pawl 101 of the tray 35 protrudes through the hole 35*b*H and engages with the long hole 102, as the pawl engaging means, of the apparatus main assembly 100A, the tray 35 is locked into the locking-unlocking position D. As the pawl 101 retracts into the tray 35 through the hole 35*b*H, it becomes disengaged from the long hole 103.

Therefore, the tray 35 can be changed in position from the locking-unlocking position D to the image formation position C, or from the image formation position C to the locking-unlocking position D, while the ejection prevention pawl 101 and engaging means 102 of the apparatus main assembly 100A remain engaged with each other.

When the tray 35 is in the locking-unlocking position D, the ejection prevention pawl 101 remains engaged with the engaging means 102 of the apparatus main assembly 100A. Thus, the tray 35 is locked in the locking-unlocking position D. That is, the tray 35 is prevented from moving.

As the handle 35*a* is pulled frontward while the tray 35 is in the locking-unlocking position D, the ejection prevention pawl 101 is retracted into the hole 35*b*H, becoming disengaged from the pawl engaging means 102 of the apparatus main assembly 100A. Thus, the tray 35 is freed, and therefore, is made to slightly protrude from the apparatus main assembly 100A by the force applied to the tray 35 by the spring 103 through the pressing member 104. At this point, the user can pull the tray 35 by the handle 35*a* to slide the tray 35 to the mounting-dismounting position E.

On the other hand, as the tray 35 is pushed into the apparatus main assembly 100A from the mounting-dismounting position E, the rear sub-frame 35*c* of the tray 35 comes into contact with the pressing member 104 slightly before the tray 35 reaches the locking-unlocking position D. Then, as the tray 35 is pushed further into the apparatus main assembly 100A against the force being applied to the tray 35 through the pressing member 104, the ejection prevention pawl 101 engages with the pawl engaging means 102 as soon as the tray 35 reaches the locking-unlocking position D. Consequently, the tray 35 is locked in the locking-unlocking position D. That is, the tray 35 is prevented from moving.

<<Interface Portion>>

Next, the structure of the interface portion between each cartridge P and apparatus main assembly 100A, that is, the structural arrangement for supplying each cartridge P with electrical power, is described along with the structure of the pressing member and the structure of the driving force transmission coupling.

(Structure of Power Supplying Means)

Figure 18:
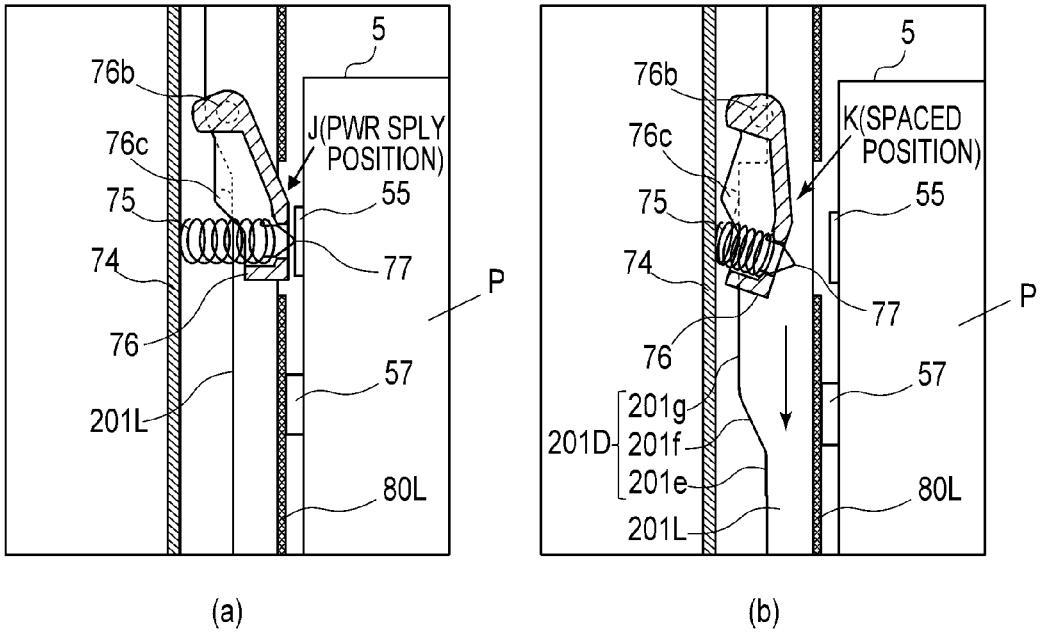
FIG. 18 is an illustration of a means for electric energy supply to the cartridge.

FIGS. 17 and 18 are drawings for describing the method for supplying electric power to each cartridge P from the apparatus main assembly 100A. The left side (non-drive side: other side) of the inward of the apparatus main assembly 100A is provided with electrical contact springs 75 (75*a*, 75*b*, 75*c* and 75*d*), which are power supplying members (electrical contact units) for supplying the electrical contact (power supply contact) 55 of each cartridge P with electric power.

FIG. 17 (part (a)) is a perspective view of the combination of the door 31, tray 31, etc., as seen from the left side of the combination, after the tray 35 was pulled out of the apparatus main assembly 100A to the mounting-dismounting position E by the opening of the door 31. Each cartridge P is supported by the tray 35, being aligned in the direction which is parallel to the horizontal direction of the apparatus main assembly 100A. The left surface of each cartridge P is provided with the electrical contact 55, which is attached to a specific point of the left surface, in terms of the vertical direction. All cartridges P are the same in the position to which the electrical contact 55 is attached.

The apparatus main assembly 100A is provided with a power supplying portion 75, and electrical contact springs 75*a*-75*d* which are in connection to the power supplying portion 74. The electrical contact springs 75*a*-75*d* are aligned in the direction parallel to the horizontal direction of the apparatus main assembly 100A. In terms of the vertical direction, they are at the same level. FIG. 17 (part (b)) is an enlarged view of one of the electrical contact springs 75 and its adjacencies. FIG. 17 (part (c)) is an enlarged perspective view of one of the electrical contact springs 75 and its adjacencies, as seen from the inward side of the left sub-frame 80L.

One end of each of the electrical contact springs 75*a*-75*d* of the apparatus main assembly 100A is electrically in connection with the electrical power supplying portion 75 of the apparatus main assembly 100A. The other end is held by the electrical contact spring holder 76, and its cartridge contacting point 77 is protruding toward the cartridge P through a hole 7*d* with which the electrical contact spring holder 76 is provided.

The left and right end portions 76*a* and 76*b* of the electrical contact spring holder 76 of the apparatus main assembly 100A are rotatably held by an unshown pair of bearings with which the apparatus main assembly 100A is provided. The electrical contact spring holder 76 is under the pressure generated by the resiliency of the electrical contact spring 75 in the direction to cause the cartridge contacting electrical contact 77 to come into contact with the cartridge P. However, the rotation of the shaft 76*c* of the electrical contact spring holder 76 is regulated by the cam surface 201D of the connective rod 201L.

FIGS. 18 (part (a)) and 18 (part (b)) are drawings which show how the electrical connection between the electrical contact 55 of the cartridge P and electrical contact spring 75 of the apparatus main assembly 100A is broken. That is, each of FIGS. 18 (part (a)) and 18 (part (b)) is a part of a sectional view of the combination of the electrical contact 55 of the cartridge P, electrical contact 75 of the apparatus main assembly 100A, electrical contact spring holder 76 of the apparatus main assembly 100A, power supplying portion 75 of the apparatus main assembly 100A, and connective rod 201L, as seen from the top side of the apparatus main assembly 100A.

FIG. 18 (part (a)) shows the state of the combination, in which the door 31 is completely closed, and each cartridge P is in its image formation position, into which the cartridge P was made to move downward, by the downward movement of the tray 35 to the image forming position C. When the combination is in the state shown in FIG. 18 (part (a)), the cartridge contact contacting portion 77 of the electrical contact spring 75 of the apparatus main assembly 100A has protruded toward the cartridge P through the hole cut through the left sub-frame 80L, and is in contact with the electrical contact 55 of the cartridge P.

That is, when the door 31 is in the closed position A, the main assembly electrical contact spring 75 is in its power supplying position J, in which it can supply electric power to the electrical contact of the cartridge P. That is, the main assembly electrical contact 75 and electrical contact of the cartridge P are electrically in contact with each other.

FIG. 18 (part (b)) shows the state of the afore-mentioned combination, in which each cartridge is in its image formation position, into which it has been moved upward, by the upward movement of the tray 35 from the image forming position C to the locking-unlocking position D. As the connective rod 201L is moved frontward of the apparatus main assembly 100A by the rotational opening movement of the door 31, the main assembly electrical contact spring holder 76 is rotationally moved by the rotational opening movement of the door 31, in the direction to cause the main assembly electrical contact spring 75 to separate from the electrical contact 55 of the cartridge P by its cam surface 201D.

That is, when the door 31 is in the open position B, the main assembly electrical contact spring 75 is in the separation position K in which it remains separated from the electrical contact 55 of the cartridge P. Thus, the electrical connection between the main assembly electrical contact spring 75 and the electrical contact 55 of the cartridge P was broken.

Further, when the combination is in the state shown in FIG. 18 (part (b)), the cartridge electrical point contacting portion 77 has retracted outward of the apparatus main assembly 100A through the hole cut through the left sub-frame 80L. Thus, the tray 35 can be pulled out, without coming into contact with the main assembly electrical contact spring 75.

The cam surface 201D of the connective rod 201L is made up of straight portions 201*e* and 201*g*, and a slanted portion 201*f*. Thus, when the door 31 is completely shut against the apparatus main assembly 100A (in closed position A), the main assembly electrical contact spring 75 remains in contact with the electrical contact 55 of the cartridge P (electric power supplying position J). On the other hand, when the door 31 is fully open (in open position B), the main assembly electrical contact spring 75 remains separated from the electrical contact 55 of the cartridge P (separation position K).

The following can be said about the amount of the stroke of the main assembly electrical contact spring 75, which is caused by the rotational movement of the electrical contact spring holder 76, that is, the amount of stroke of the main assembly electrical contact spring 75 from the power supplying position J, in which it is when the door 31 is completely closed, and in which it contacts the electrical contact 55 of the cartridge P, to the separation position K, in which it is when the door 31 is fully open.

That is, this stroke has to be large enough to prevent the main assembly electrical contact spring 75 from coming into contact with the electrical contact 55 of the cartridge P when the tray 35 is pulled out of the apparatus main assembly 100A, and small enough to ensure that the main assembly electrical contact spring 75 comes into contact with the electrical contact 55 of the cartridge P, even if the errors in the measurement of the components of the above described combination, which are attributable to the tolerance in the measurement of the components, are at the largest limit. The larger the amount of this stroke, the larger the margin which the components are afforded in terms of the tolerance in component measurement. However, the larger the amount of this stroke, the larger the amount by which the main assembly electrical contact spring 75 has to be compressed by the opening movement of the door 31, which results in an increase in the amount of force to be applied by a user to open the door 31. Therefore, it is important to reduce the amount of the stroke of the main assembly electrical contact spring 75 as much as possible, that is, to ensure that the components related to the stroke of the main assembly electrical contact spring 75 can be precisely positioned.

As described above, in this embodiment, in order to precisely position each cartridge P in terms of the left-right direction, the positioning projection 57 of each cartridge P, which is for precisely positioning the cartridge P in terms of the left-right direction, is placed in contact with the left sub-frame 80L. Therefore, it is possible to reduce the nonuniformity in the distance from the cartridge electrical contact 55 to the main assembly electrical contact spring 75, by precisely positioning the shaft portion of the main assembly electrical contact spring holder 76, and connective rod 201L, in terms of the left-right direction, by placing them in contact with the left sub-frame 80L. That is, it is possible to reduce the amount of the force which a user has to exert when the user tries to open or closes the door 31.

The above-mentioned FIGS. 17 and 18 show the method which employs only one main assembly electrical contact spring 75 to supply each cartridge P with electrical power through the electrical contact 55, through which the cartridge P is supplied with electric power. However, the same structural arrangement as the one described above can be used even in a case where each cartridge P is provided multiple portions through which it is supplied with electrical power. In such a case, the apparatus main assembly 100A may be structured so that the main assembly electrical contact spring holder 76 holds multiple main assembly electrical contact springs 75, or multiple main assembly electrical contact spring holder 76 are provided for each cartridge P.

In the above-mentioned FIGS. 17 and 18, the left and right end portions 76*a* and 76*b* of the main assembly electrical contact spring holder 76 are rotatably held by a pair of bearings, between the bearings. Further, the image forming apparatus 100 is structured so that the main assembly electrical contact spring 75 is placed in contact with, or separated from, the electrical contact 55 of the cartridge P by the rotational movement of the main assembly electrical contact spring holder 76. However, the image forming apparatus 100 may be structured so that the main assembly electrical contact spring 75 is placed in contact with, or separated from, the electrical contact 55 of the cartridge P by being horizontally moved in the left-right direction of the apparatus main assembly 100A, as in the case of the structure of the driving force transmitting coupling, which will be described later.

(Structure of Pressing Member)

Referring to FIGS. 13, 14, 17 and 19, there are left and right positioning members 81L and 81R at the left and right ends, respectively, of the internal space of the apparatus main assembly 100A. Each of the left and right positioning members 81L and 81R is provided with positioning portions 41 which catch the drive side bearing 51 and non-drive side bearing 52 of each cartridge P, by their bottom surface portions. There are also pressing members 42 which press on the left and right end portions of the top surface of each cartridge P in order to cause the drive side bearing 51 and non-drive side gearing 52 to fit into, and remain in, the corresponding positioning portions 41, at the left and right ends of the internal space of the apparatus main assembly 100A.

Figure 20:
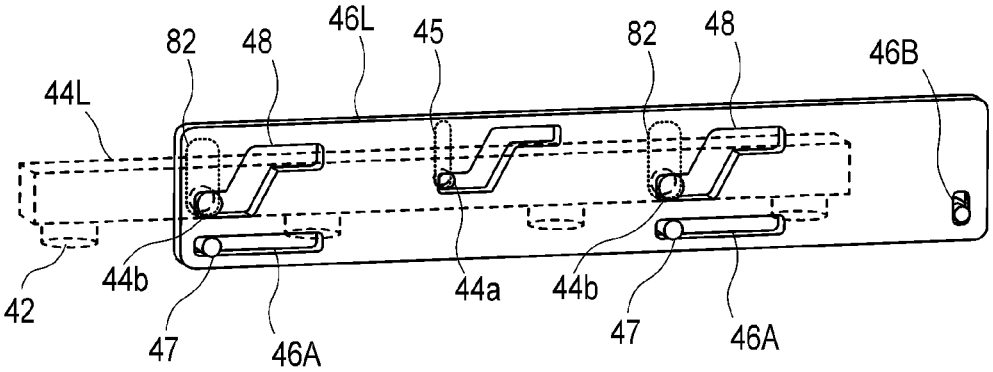
FIG. 20 is a perspective view illustrating a means for urging the cartridge.
Figure 23:
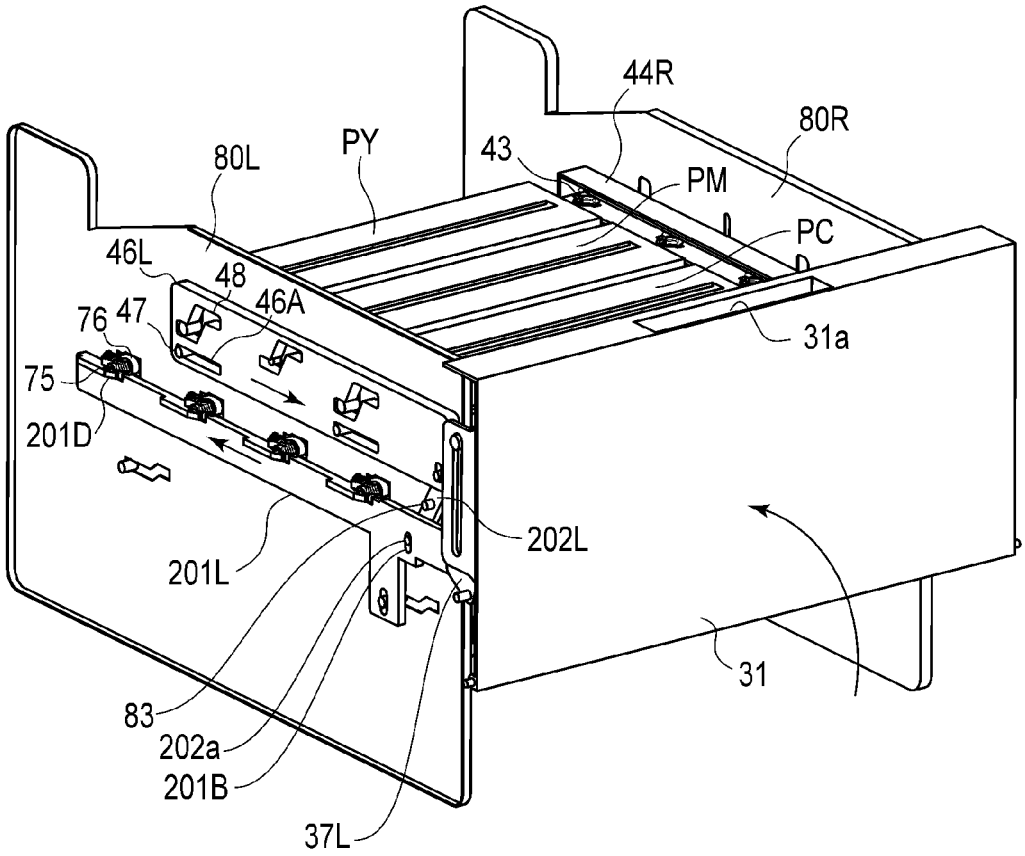
FIG. 23 is an illustration of the means for urging the cartridge.

FIG. 23 is a perspective view of the portions of the image forming apparatus 100, which are related to the present invention, as seen from the left side of the image forming apparatus 100, when the door 31 is remaining closed. FIG. 19 is a perspective view of the portions of the image forming apparatus 100, which are related to the present invention, as seen from the right side of the image forming apparatus 100, after the tray 35 was moved to the mounting-dismounting position E by the opening of the door 31, as shown in FIG. 17. FIG. 20 is a perspective view of a part of the pressing mechanism, and shows the structure of the pressing mechanism.

Referring to FIGS. 17, 19 and 23, there are provided pressing member rods 46L and 46R, on the outward side of the left and right sub-frame 80L and 80R, respectively. There are also provided rod linking members 202L and 202R for moving together the connective rods 201L and 201R, and pressing member rods 46L and 46R, respectively, on the outward side of the left and right sub-frame 80L and 80R, respectively.

Each of the left and right pressing member rods 46L and 46R is provided with a pair of long and narrow holes 46A, which are positioned apart by a preset distance, in terms of the front-rear direction. Each of the left and right sub-frames 80L and 80R of the apparatus main assembly 100A is provided with a pair of pin shafts 47, which are positioned apart by a preset distance, in terms of the front-rear direction. These pin shafts 47 are fitted in the corresponding long and narrow holes 47A, one for one, whereby the pressing member rods 46L ad 46R are supported by the left and right sub-frames 80L and 80R, respectively, in such manner that the former can be moved in the front-rear direction relative to the latter.

The left and right rod linking members 202L and 202R are rotatably supported by the link rotation shafts 83, with which the left and right sub-frames 80L and 80R of the apparatus main assembly 100A are provided, one for one. The rod linking members 202L and 202R are provided with horizontal shafts 202*a* and 202*b*, respectively.

The horizontal shaft 202*a* of the left rod linking member 202L is fitted in the vertical long hole 201B of the left connective rods 201L, whereas the horizontal shaft 202*b* is fitted in the vertical long hole 46B of the left pressing member rod 46L.

Similarly, the horizontal shaft 202*a* of the right rod linking member 202R is fitted in the vertical long hole 201B of the right connective rod 201R, connecting thereby the right rod linking members 202R and right connective rod 201R. The horizontal shaft 202*b* is fitted in the vertical long hole 46B of the right pressing member rod 46R.

Therefore, as the connective rods 201L and 201R are moved in the front-rear direction, the pressing member rods 46L and 46R are moved in the front-rear direction by the movement of the connective rods 201L and 201R, through the rod linking members 202L and 202R, respectively. That is, as the door 31 is opened or closed, the pressing member rods 46L and 46R are moved in the front-rear direction by the rotational opening and closing movement of the door 31, respectively.

As the door 31, which is in the closed state (FIG. 23), is opened (FIG. 17), the connective rods 201L and 201R are moved frontward of the apparatus main assembly 100A, as described above. During this movement of the connective rods 201L and 201R, the pressing member rods 46L and 46R are moved rearward of the apparatus main assembly 100A by the movement of the connective rods 201L and 204R, through the rod linking members 202L and 202R. On the other hand, as the door 31, which is open (FIG. 17), is closed (FIG. 23), the connective rods 201L and 201R move rearward of the apparatus main assembly 100A. The pressing member rods 46L and 46R are moved frontward of the apparatus main assembly 100A by the movement of the connective rods 201L and 201R, through the rod linking members 202L and 202R, respectively.

Further, the pressing members 42 are movable relative to the pressing member holder 44L and 44R disposed on the inward side of the left and right sub-frames 80L and 80R, respectively, in the direction parallel to the vertical direction of the apparatus main assembly 100A. Moreover, the pressing members 42 are under the pressure generated by the compression springs 43 in the direction to cause the pressing members 42 to press on the left and right end portions of the top surface of the cartridge P.

Referring to FIG. 20, each of the left and right pressing member holder 44L and 44R is provided with a pin shaft 44*a*, which is located at the center of the holder 44. These pin shafts 44*a* are fitted in the pair of vertical long holes 45 with which the left and right sub-frames 80L and 80R of the apparatus main assembly 100A are provided, one for one.

Moreover, each of the left and right pressing member holder 44L and 44R is provided with a pair of pin shafts 44*b*, which are separated by a preset distance. The pair of pin shafts 44*b* are put through a pair of vertical long holes 82, one for one, with which each of the left and right sub-frames 80L and 80R is provided. Further, they are fitted in the guiding holes 48 with which each of the left and right pressing member rods 46L and 46R is provided.

Therefore, the left and right pressing member holder 44L and 44R are regulated by the left and right pressing member rods 46L and 46R, respectively, in their position in terms of the direction parallel to the vertical direction of the apparatus main assembly 100A. Further, they are regulated by the vertical long holes 45 of the left and right sub-frames 80L and 80R, in their position in terms of the front-rear direction. That is, the left and right pressing member holders 44L and 44R are moved only in the vertical direction by the movement of the left and right pressing member rods 46L and 46R in the front-rear direction.

Figure 21:
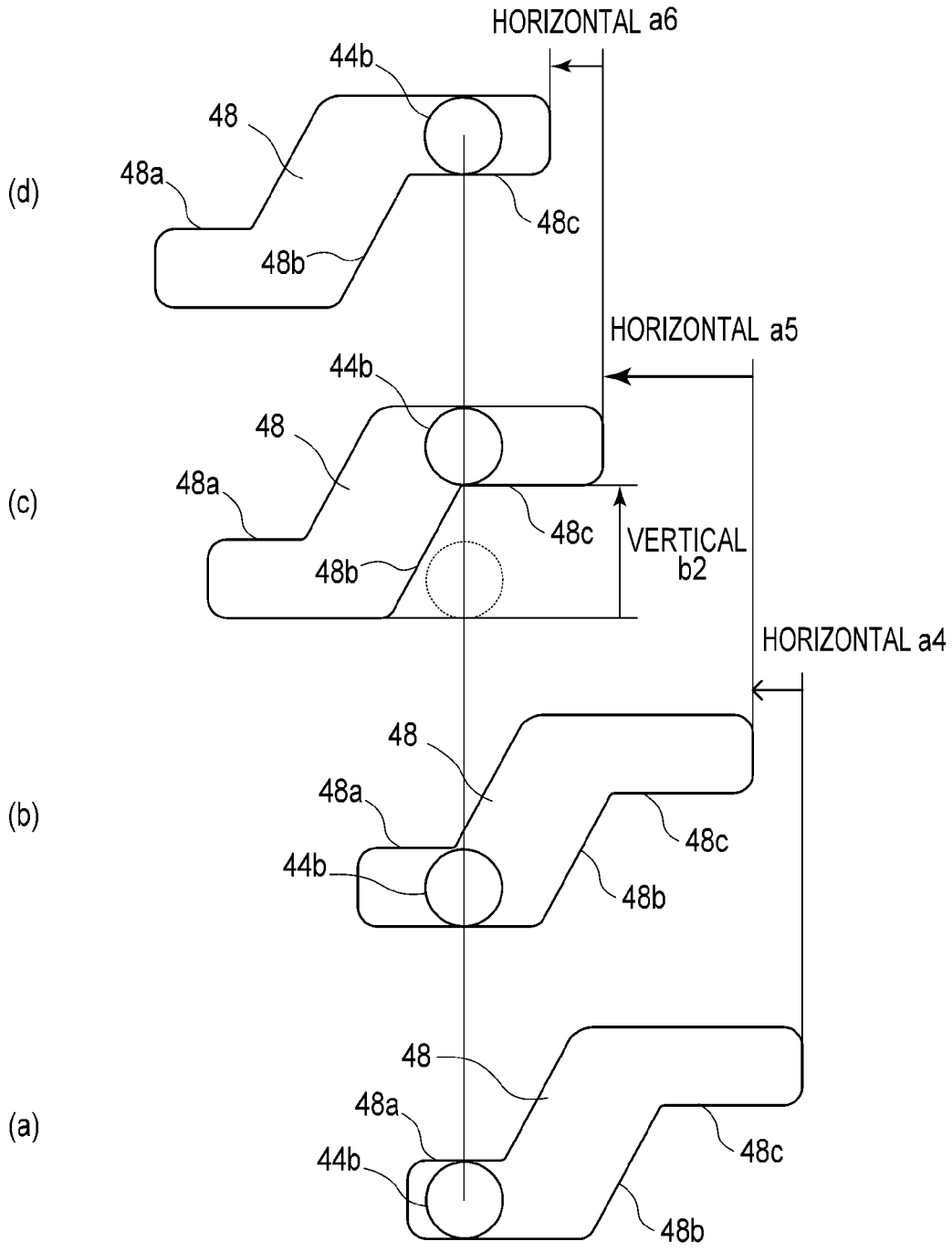
FIG. 21 is an enlarged view of a guiding hole portion of the means for urging the cartridge.

FIG. 21 is an enlarged view of the guiding hole 48 of the pressing member rod 46L and its adjacencies, as seen from the left side of the apparatus main assembly 100A. Each guiding hole 48 has: the first guiding portion 48*a* which is horizontal and extends in the front-rear direction; the second guiding portion 48*b* which extends frontward from the downstream end of the first guiding portion 48*a* in terms of the direction in which the pin shaft advances, and has upward inclination; and the third guiding portion 48*c*, which horizontally extends frontward from the top end of the second guiding portion 48*b*, and catches and securely holds the pin shaft 44*b*.

FIG. 21 (part (a)) shows the positional relationship in which the guiding hole 48 and pin shaft 44*b* are when the door 31 is remaining completely closed. When the relationship between the guiding hole 48 and pin shaft 44*b* is as shown in FIG. 21 (part (a)), the pressing member rod 46L is on the front side of the apparatus main assembly 100A. Therefore, the pin shaft 44*b*, that is, the pressing member holder 44L, is regulated in position by the first guiding portion 48*a* in terms of the vertical direction. Further, each pressing member is pressing on the left side of the top surface of the cartridge P.

FIGS. 21 (part (b)) and 21 (part (c)) show the positional relationship in which the guiding hole 48 and pin shaft 44*b* are when the door 31 is partially open. As the door 31, which was remaining closed, is opened, that is, when the positional relationship is as shown in FIG. 21 (part (a)), the pressing member rod 46L is moved rearward of the apparatus main assembly 100A by the opening movement of the door 31. Thus, the pin shaft 44*b* is guided by the second guiding portion 48*b* of the guiding hole 48. Consequently, the pressing member holder 44L moves upward.

During this movement of the pressing member holder 44L, the pin shaft 44*a* of the pressing member holder 44L is in the vertical long hole 45 with which the left sub-frame 80L is provided. Therefore, it does not occur that the pressing member holder 44L horizontally moves. That is, the pressing member holder 44L moves only in the vertical direction. Consequently, the pressing member 42 separates from the top-left surface of the cartridge P.

FIG. 21 (part (d)) shows the positional relationship in which the guiding hole 48 and pin shaft 44*b* are when the door 31 is fully open. When the guiding hole 48 and pin shaft 44*b* are in the state shown in FIG. 21 (part (d)), the pressing member rod 46L is on the rear side of the apparatus main assembly 100A. Therefore, the pin shaft 44*b*, that is, the pressing member holder 44L, is remaining fixed in position, in terms of the vertical direction, by the third guiding portion 48*c*. That is, the pressing member 42 is remaining separated from the top-left surface of the cartridge P.

Although FIG. 21 shows the contact and separation of only the left pressing mechanism of the apparatus main assembly 100A, the right pressing mechanism of the apparatus main assembly 100A is similar in structure, contact, and separation, as the left one.

Therefore, while the pin shafts 44*b*, that is, the left and right pressing member rods 46L and 46R, are horizontally moved by a distance a4 by the rotational movement of the door 31, the left and right pressing member holders 44L and 44R are prevented from vertically moving, by the first guiding portion 48*a*. Then, while the left and right pressing member rods 4L and 46R move by a distance a5, the left and right pressing member holders 44L and 44R are vertically moved by a distance b2 by the second guiding portion 48*b*.

Lastly, while the left and right pressing member rods 46L and 46R move by a distance a6, the left and right pressing member holders 46L and 44R are prevented from vertically moving, by the third guiding portion 48*c*. The vertical long hole 82, with which each of the left and right sub-frames 80L and 80R is provided, is large (long) enough, compared to the vertical moving range of the pin shaft 44*b*. Therefore, it does not occur that the pin shafts 44*b* are regulated in movement during this movement of the left and right pressing member rods 46L and 46R.

FIGS. 22 (part (a)) and 22 (part (b)) show how the pressing members 42 come into contact with, or separate from, the left and right portions of the top surface of the cartridge P. FIGS. 22 (part (a)) and (part (b)) are parts of the sectional views of the combination of the cartridge P, pressing member 42, compression spring 4*e*, and pressing member holder 44, as seen from the left side of the apparatus main assembly 100A.

FIG. 22 (part (a)) shows the state of the abovementioned combination, in which the door 31 is completely closed (in closed position A), and each cartridge P is remaining precisely positioned in its preset image forming position, by being pressed by the pressing member 42. When the combination is in the state shown in FIG. 22 (part (a)), the pressing member holder 44 and pressing member 42 are kept in their lowest position by the first guiding portion 48*a*. Further, the pressing members 42 are remaining stationary in the positions in which they are in contact with the left and right portions of the top surface of each cartridge P, being therefore prevented from moving downward. Therefore, there is a gap (distance b3) between the engaging portion 44*c* of the pressing member holder 44, and the corresponding engaging portion 42*a* of the pressing members 42.

That is, the pressing member 42 is in the contacting position H in which it prevents the cartridge P from moving, by remaining in contact with the cartridge P. Therefore, the pressing member 42 is made to press on the left and right portions of the top surface of the cartridge P, by the force which it receives from the compression spring 43. Thus, the bearing 51 on the drive side, and the bearing 52 on the non-drive side, are fitted in the cartridge positioning portions 41, being thereby precisely fixed in position.

The direction in which the pressing member 42 comes into contact with the cartridge P is as follows. That is, it is perpendicular to the direction (connecting direction) in which the drum driving coupling 39, which is a driving force transmitting member (which will be described later) engage with the cartridge P. It is also perpendicular to the direction (contacting direction) in which the above-described electrical power supplying member 75 comes into contact with the cartridge P.

FIG. 22 (part (b)) shows the state of the abovementioned combination, in which the door 31 is fully open (open position B); each cartridge P has been freed from the pressure; and each cartridge P is in the position into which it has risen from its image forming position. As the pressing member rod 46 is moved rearward of the apparatus main assembly 100A by the rotational opening movement of the door 31, the pressing member holder 44 is kept by the third guiding portion 48*c* of the pressing member rod 43, in its highest level to which it was pushed up by the second guiding portion 48*b*. As the pressing member holder 44 is moved by the distance b3 when it is in the state shown in FIG. 22 (part (a)), that is, when it is under the pressure from the compression spring 43, the engaging portion 44*c* of the pressing member holder 44 comes into contact with the corresponding engaging portion 42*a* of the pressing member 42.

Thereafter, therefore, the pressing member holder 44 and pressing member 42 are moved upward together. The amount (b2-b3) by which the pressing member 42 is moved upward is set to be greater than the amount (b1) of the above described upward movement of the cartridge P. Therefore, the cartridge P is freed from the pressure, and the pressing member 42 retracts into the position in which it does not interfere with the horizontal movement of the tray 35.

That is, when the door 31 is in the open position B, the pressing member 42 is in the separation position I, in which it remains separated from the cartridge P. Therefore, as the door 31 is opened, each cartridge P is freed from the pressure applied thereto in the left-right direction.

(Structure of Drive Coupling Member)

Figure 25:
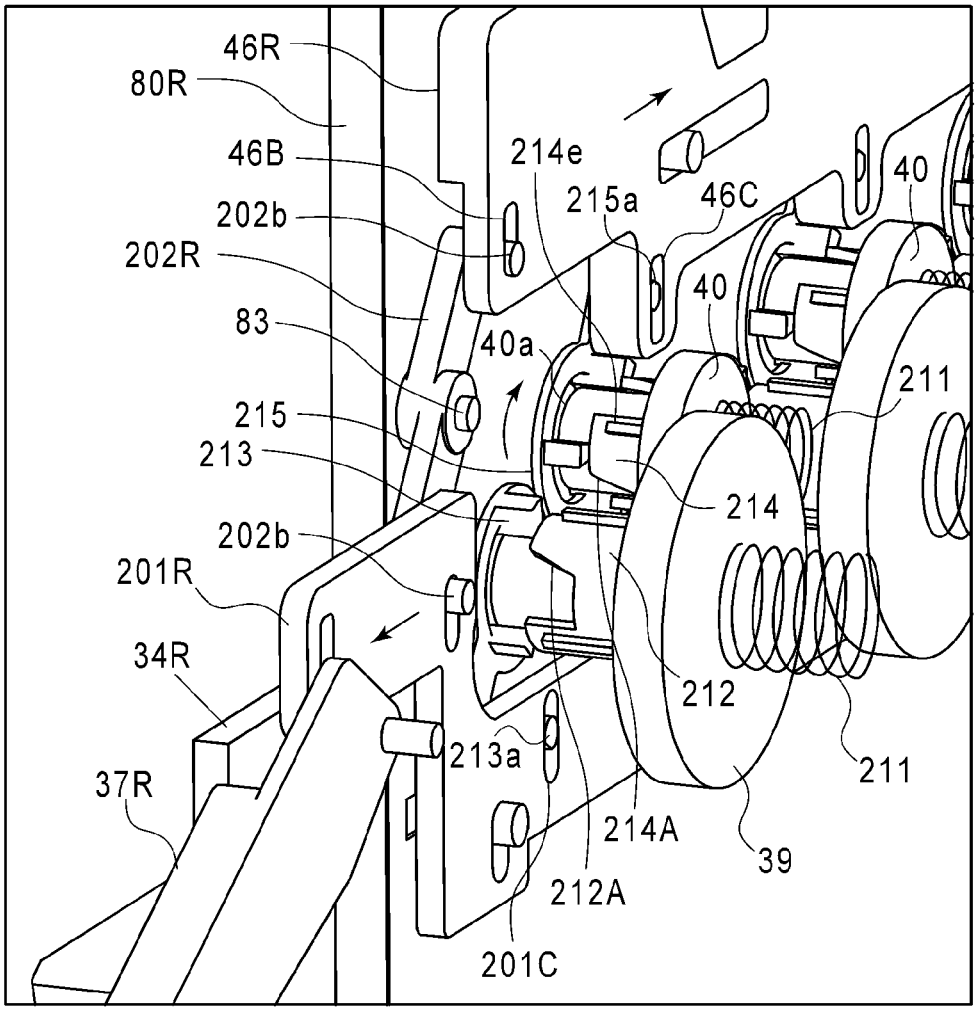
FIG. 25 is an illustration of a means for transmitting a driving force to the cartridge.

As shown in FIGS. 19, 25, in the right side of the main assembly 100A, there are provided a drum driving coupling 39 and a developing drive coupling 40. The drum driving coupling 39 and in the developing drive coupling 40 are drive outputting portion (drive transmission members) for engagement with a drive inputting portion (drive connecting portion) 53, 54 of the cartridge P two rotate the drum 1 and the developing roller 3*a* and so on of the cartridge P.

Figure 24:
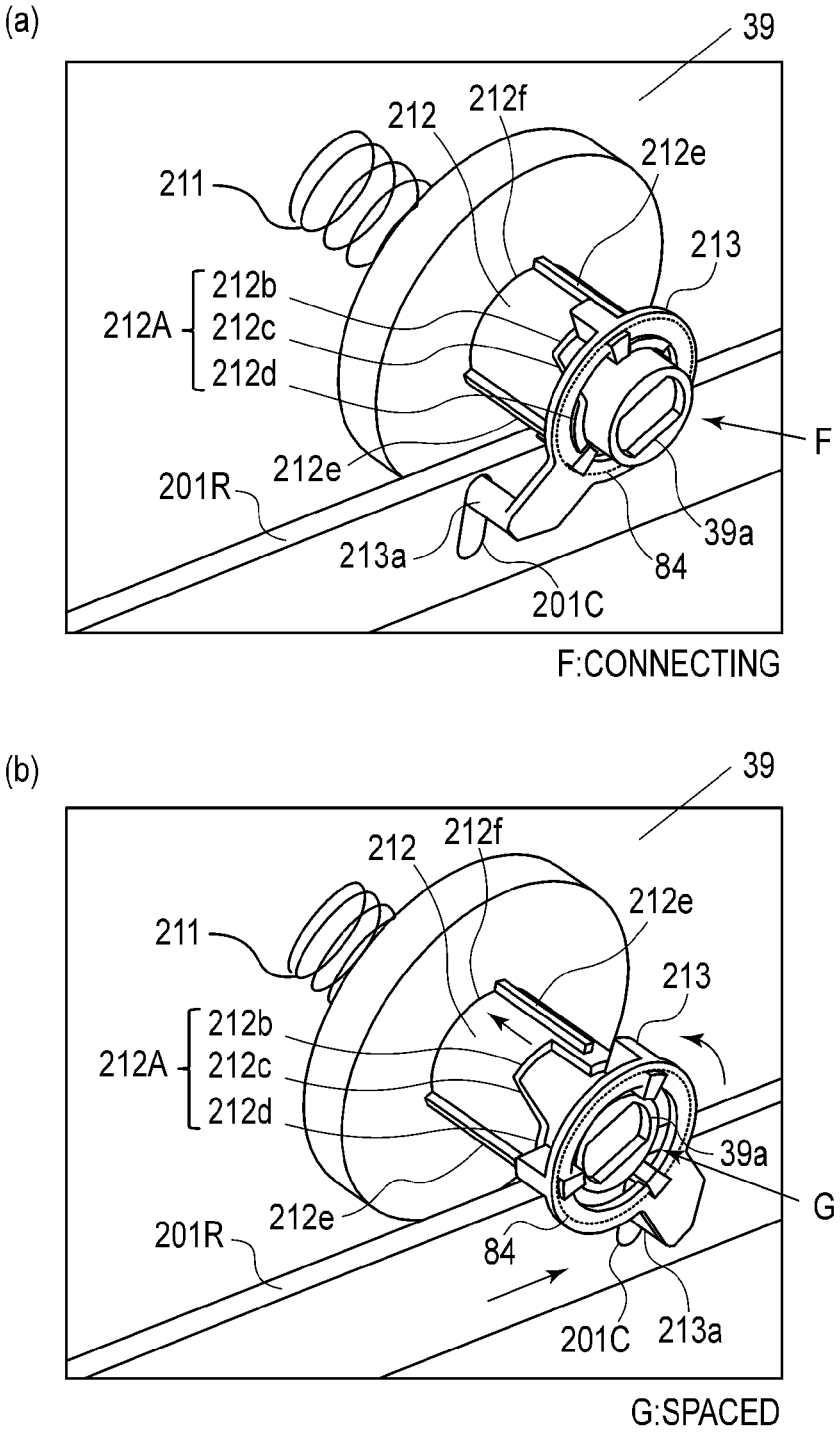
FIG. 24 is an illustration of a means for transmitting a driving force to the cartridge.

FIG. 24 is a partly enlarged view illustrating engagement and disengagement of the drum driving coupling 39 relative to the drive inputting portion 53 of the cartridge P, in which the right-hand frame 80R and the cartridge P are omitted for simplicity. FIG. 25 is a perspective view as seen from the right side of the main assembly in the state that the door 31 is open (open position B), illustrating the structures of the drum driving coupling 39 and the developing drive coupling 40.

The drum driving coupling 39 and the developing drive coupling 40 it supported so as to be rotatable relative to a driving unit shaft (unshown) provided on an outside of the right-hand frame 80R so as to be movable along the rotational axial direction. Coupling urging springs (urging means, urging members) 211 are provided to urge coupling portions 39*a*, 40*a* and the drive inputting portions 53, 54 of the cartridge.

As shown in FIG. 17, the right-hand frame 80R is provided with a round hole 84 at the center of the drum driving coupling 39, and a drum driving coupling release lever 213 is rotatably engaged with the round hole 84.

As shown in FIGS. 24 and 25, one end portion of the drum driving coupling release lever 213 is provided with a pin shaft 213*a*. The pin shaft 213*a* of the drum driving coupling release lever 213 is engaged with a longitudinal elongated hole 201C provided in a right side connection rod 201R. A drum driving coupling release cam 212 is engaged with the drum driving coupling release lever 213, and movable in the rotational axis direction of the drum driving coupling 39.

The drum driving coupling release cam 212 is limited in the rotational axis direction of the drum driving coupling release lever 213 by a rib 212*e* (unshown) provided on the drum driving coupling release cam 212 being supported by the holder member.

Part (a) of FIG. 24 is an enlarged view of the drum driving coupling 39, in which the door 31 is closed (closing position A) relative to the main assembly 100A. In this state, the coupling portion 39*a* of the drum driving coupling 39 it projected into the inside of the main assembly of the apparatus to such an extent as to contact to the drive inputting portion 53 of the cartridge by a coupling urging spring 211. That is, the drum driving coupling 39 is in a connecting position F in which the driving force can be transmitted to the drive inputting portion 53 of the cartridge P, when the door 31 is in the closing position A.

Part (b) of FIG. 24 shows the state in which the door 31 is sufficiently opened. When the door 31 is open from the closed state shown in part (a) of FIG. 24, the connection rod 201R of the right side is pulled in the main assembly 100A toward the front side. By this, the drum driving coupling release lever 213 rotates relative to the drum driving coupling release cam 212. At this time, the drum driving coupling release cam 212 moves toward the right side of the main assembly along the axial direction by the cam surface 212A of the drum driving coupling release cam 212.

By this, an end surface 212*f* of the drum driving coupling release cam 212 abuts to the drum driving coupling 39 to space the drum driving coupling 39 from the drive inputting portion 53 of the cartridge against the urging force of coupling urging spring 211. Thus, when the door 31 is it the open position B, the drum driving coupling 39 is in the spacing position G where it is disengaged from the cartridge P.

Similarly, the right-hand frame 80R is provided with the round hole 85 at the center of the developing drive coupling 40, and the developing drive coupling release lever 215 is rotatably engaged with the round hole 85 (FIGS. 17, 25).

One end portion of the developing drive coupling release lever 215 is provided with a pin shaft 215*a*. The pin shaft 215*a* of the developing drive coupling release lever 215 is engaged with a longitudinal elongated hole 46C provided in the right side urging member rod 46R.

Furthermore, the developing drive coupling release cam 214 is engaged with the developing drive coupling release lever 215, and is movable in the rotational axis direction of the developing drive coupling 40. A rib 214*e* (unshown) provided on the developing drive coupling release cam 214 is held by the holder member, by which the developing drive coupling release cam 214 is limited in the direction of the rotational direction of the developing drive coupling release lever 215.

When the door 31 is open from the closed state, the right side connection rod 201R moves toward the front side of the main assembly 100A in interrelation with the opening of the door 31. Simultaneously with the right side connection rod 201R moving toward the front side in the main assembly A, the urging member rod 46R moves toward the rear side in the main assembly through the rod link 202R. By this, the developing drive coupling release lever 215 is rotated relative to the developing drive coupling release cam 214.

At this time, the developing drive coupling release cam 214 is moved toward with toward the right side along the rotational shaft by the cam surface 214A of the developing drive coupling release cam 214. By this, the end surface of the developing drive coupling release cam 214 abuts to the developing drive coupling 40 to move the developing drive coupling 40 in the direction away from the cartridge side drive inputting portion 54 against the urging force of the coupling urging spring 211.

In this state, the drum driving coupling 39 and the developing drive coupling 40 are in the retracted position not limiting the vertical movement of the tray 35 and the horizontal movements of the tray 35 and the cartridges.

As shown in FIG. 24 the cam surface 212A of the drum driving coupling release cam 212 includes straight portions 212*b* and 212*d*, and an inclined surface portion 212*c*. By this, the drum driving coupling 39 keeps engaging with the cartridge P (connecting position F) when the door 31 is sufficiently closed relative to the main assembly 100A (closing position A). In addition, when the door 31 is sufficiently opened (open position B), it keeps disengaged from the cartridge P (spacing position G).

The cam surface 214A of the developing drive coupling release cam 214 has a similar structure. Therefore, when the door 31 is sufficiently closed relative to the main assembly 100A (closing position A), it keeps engaged with the cartridge P (connecting position F). In addition, when the door 31 is sufficiently opened (open position B), it keeps disengaged from the cartridge P (spacing position G).

(Operation Timing of Interface Portion)

With the structures as described in the foregoing, the interface portions are disengaged from the respective cartridges P unit the relation with the movement of the door 31 from the closing position A to the open position B. More particularly, the main assembly electrical contact spring 75, the urging member 42, the drum driving coupling 39 and the developing drive coupling 40 are released. In the state that the tray 35 is raised from the image forming position C to the movable position D by the tray holding member 34, the tray 35 is freely slidable between the movable position D and the mounting and demounting position D.

Therefore, the tray 35 can be drawn out of the main assembly 100A and can be inserted into the main assembly A, while carrying the cartridges P.

As described in the foregoing, the main assembly electrical contact spring 75, the urging member 42, the drum driving coupling 39, the developing drive coupling 40 and the tray 35 move in interrelation with the movement of the door 31. The operating operation timings can be adjusted, respectively, by the configurations of the cam surface of the operation control mechanism.

For example, the timing at which the tray 35 moves in the vertical direction is adjustable by changing the position of the guide region 36*b* in the horizontal direction within the guiding hole 36 shown in FIG. 12. By selecting the length guide region 36*a* and a short guide region 36*c*, the tray 35 can be moved downwardly at the timing closer to the start of the door 31 closing operation in the full range of the closing operation of the door 31 from the start to the end.

Similarly, the operation timing of the main assembly electrical contact spring 75 is adjustable by the cam surface 201D (FIG. 18) of the connection rod 201L.

The operation timing of the urging member 42 is adjustable by the guiding hole 48 (FIG. 21) of the urging member rod 46.

The operation timing of the drum driving coupling 39 is adjustable by the cam surface 212A (FIG. 24) of the drum driving coupling release cam 212.

The operation timing of the developing drive coupling 40 is adjustable by the cam surface 214A (FIG. 25) of the developing drive coupling release cam 214.

In this embodiment, the operation timings are determined such that the operations are carried out along the course of the closing operation of the door 31.

The left and right tray holding members 34 finish the oblique downward movement caused by the second guide region 36*b* of the guide portion 36, and the pin shafts 34*c*, 34*d* are placed in the horizontal first guide region 36*a*. That is, the tray 35 moves downwardly, the bottom surface portions of the driving side shaft receiving portion 51 and the non-driving side shaft receiving portion 52 of the cartridge are received in the positioning portion 41 provided in the left and right positioning members 81L, 81R of the main assembly.

By the rotation of the drum driving coupling release lever 213, the drum driving coupling release cam 212 finishes the inward movement caused by the inclined surface portion 212*c*. That is, the drum driving coupling 39 is urged by the coupling to engage with the drive inputting portion 53. Similarly, by the rotation of the developing drive coupling release lever 215, the developing drive coupling release cam 214 finishes the inward movement caused by the inclined surface portion 214*c*. That is, the developing drive coupling 40 is urged by the coupling to engage with the drive inputting portion 54 of the cartridge side.

At this time, each of the cartridge P is shifted to the left side of the main assembly by the urging force of the coupling urging spring 211 through the drum driving coupling 39 and the developing drive coupling 40. Thus, the left-right direction positioning projection portion 57 of the cartridge abuts to the left-hand frame 80L so that the position in the left-right direction is determined.

The left and right urging member rods 44 finish the downward movement caused by the second guide region 48*b* of the guiding hole 48 provided on the urging member rod 46. That is, the left and right urging members 42 move downwardly to urge the left-hand upper right surfaces of the cartridge. By this, the driving side shaft receiving portion 51 and the non-driving side shaft receiving portion 52 are engaged with the positioning portion 41 to fix them.

The main assembly electrical contact spring holder 76 finishes the inward movement caused by the inclined surface portion 201*f* of the connection rod 201L. This, cartridge electrical contact portion 77 of the main assembly electrical contact spring 75 is contacted to the cartridge electrical contact, thus establishing electrical connection therebetween.

The operation timings of the operations are summarized as follows. In interrelation with the movement of the door 31 from the open position B (FIG. 3) to the closing position A (FIG. 2), the following (1)-(4) operations are carried out in the order named.

(1) the operation of the tray 35 from the movable position D to the image forming position C (FIG. 4→FIG. 2)

(2) the operation of the drive transmission members 39, 40 from the spacing position G to the connecting position F (part (b)→(a) of FIG. 24).

(3) the operation of the urging member 42 moving from the spacing position I to the contact position H (part (b)→(a) of FIG. 22).

(4) the operation of the electric energy supply member 75 moving from the spacing position K to the electric energy supplying position J.

In the opening operation of the door 31, the operations are reciprocal, that is, in the order of (4)→(3)→(2)→(1). Along with the process of opening of the door 31, the electric energy supply mechanism 75 is first disengaged, and then the left and right urging members 42 are disengaged, and the drive coupling members 39, 40 are disengaged, and finally, the tray 35 moves upwardly (from the image forming position C to the movable position D).

The description will be made as to the advantages of the order of operations. In the closing operation of the door 31, the operation (1) is effected such that the drive inputting portions 53, 54 of each cartridge P move to the position where they are opposed to the drum driving coupling 39 and the developing drive coupling 40, respectively.

Thereafter, by the operation (2), the drum driving coupling 39 and the developing drive coupling 40 are contacted to the drive inputting portions 53, 54 of the cartridge. By this, the drum driving couplings 39 and the corresponding drive inputting portions 53 can be assuredly connected, and the developing drive couplings 40 and the corresponding drive inputting portions 54 can be assuredly connected.

In the opening operation of the door 31, the drum driving coupling 39 and the developing drive coupling 40 are disengaged from the drive inputting portions 53, 54 of the cartridge, and thereafter, the cartridges are moved upwardly with the tray 35. If the cartridge moves upwardly together with the tray 35 in the state that the drive coupling is connected with the drive inputting portion of the cartridge, only the side of the drive coupling where it is engaged with the cartridge is raised. Then, a twisting may result relative to the other end portion supported by the main assembly A even to the extent that the drive coupling is damaged.

If the tray 35 moves upwardly in the state that the drive coupling is popped out toward the inside of the main assembly from the right-hand frame 80R, the drive coupling may hit the right-hand frame 35*e* of the tray 35 even to the extent that the drive coupling may be damaged.

In view of this, the operation (2) is carried out after the operation (1). By doing so, the drum driving coupling 39 and the developing drive coupling 40 can be prevented from being damaged by the twisting between the main assembly side supporting portion and the cartridge connecting portion or the hitting of the tray 35 to the right-hand frame 35*e*.

By the operation (2), the cartridges P are shifted to the left side of the main assembly so that the left-right direction positioning projection portion 57 of the cartridge P abuts to the left-hand frame 80L.

As described hereinbefore, the main assembly 100A is provided with coupling urging springs (urging means) 211 for urging the drum driving coupling 39 and the developing drive coupling 40 to the drive inputting portions 53, 54 of the cartridge P. The cartridge P is moved by the spring 211 from the side having the drive inputting portions 53, 54 to the side having the electric power supply contact portion 55. By this, the cartridge P is shifted to the left side of the main assembly, and the left-right direction positioning projection portion 57 of the cartridge P abuts to the left-hand frame 80L.

Thereafter, by the operation (3), the left-hand upper right surfaces of the cartridge P is pressed to engage the driving side shaft receiving portion 51 and the non-driving side shaft receiving portion 52 with the positioning portion 41 to fix them. By this, each cartridge is assured to position precisely in the left-right direction relative to the main frame.

In the state of operation (2), the shaft receiving portions 51 and 52 of the cartridge P contact the positioning portion 41, but the normal reaction force is small, and therefore, the frictional force at the time of shifting the cartridge to the left side of the main assembly is also small. In addition, the shaft receiving portions 51 and 52 are not scraped by the rubbing with the positioning portion 41. Furthermore, the main assembly electrical contact spring 75 provided in the non-driving side is in the spaced state from the cartridge electrical contact, and therefore, when the cartridge is shifted to the left side of the main assembly, no obstructing force is received from the non-driving side.

That is, no obstruction is caused by the urging mechanism or the electric energy supply mechanism, and therefore, the force of the coupling urging spring 211 required to shift the cartridge P to the left side of the main assembly can be minimized. As described hereinbefore, in the opening operation of the door 31, the drum driving coupling 39 and the developing drive coupling 40 are moved in the horizontal direction against the urging force of the coupling urging spring 211. Therefore, the force of the coupling urging spring 211 can be made small, so that the manipulating force for opening the door 31 can be made small.

In addition, by the operation (3), the left-hand upper right surfaces of the cartridge P is pressed to engage the driving side shaft receiving portion 51 and the non-driving side shaft receiving portion 52 with the positioning portion 41 to fix them. Thereafter, by the operation (4), the main assembly electrical contact spring 75 and the cartridge electrical contact are electrically connected with each other. By this, the contact force of the main assembly electrical contact spring 75 relative to the cartridge electrical contact 55 does not push the cartridge toward the driving side (right side of the main assembly).

By the operation (2), each cartridge is positioned in place by the left-right direction positioning projection portion 57 and abuts to the left-hand frame 80L, and by the operation (3), the position thereof is fixed. By this, the positional relation in the main assembly left-right direction between the main assembly electrical contact spring 75 and the cartridge electrical contact 55 is assured with high accuracy. Therefore, as described above, the stroke of the main assembly electrical contact spring 75 can be reduced, and the user's manipulating force can be reduced at the time of opening and closing the door 31.

For these reasons, by the operations (1) to (4) at timings in this order in the process of closing the door 31, the required opening and closing force for the door 31 is reduced, and the positioning of each cartridge P can be assured.

The operations (1) to (4) are not required to be carried out completely independently from each other. For example, during the operation (1), the operation (2) may be started, if the operation (1) is completed prior to the start of contact of the drum driving coupling 39 and the developing drive coupling 40 to the drive inputting portions 53 and 54 of the cartridge. More particularly, it is satisfactory if the drive inputting portions 53 and 54 of each cartridge P has already been in the position opposing the drum driving coupling 39 and the developing drive coupling 40, respectively.

In order to reduce the force required to open and close the door 31, the operation timings in the operations (2) to (4) may be offset for the respective cartridges. For example, in the operation (2), the timings at which the drum driving couplings 39 contacts the drive inputting portions 53 of the cartridges PY, PM, PC, PK are preferably offset slightly since then the load applied to the door 31 can be distributed.

In addition, in the operation (2), the timing at which the drum driving coupling 39 contacts the drive inputting portion 53 of the cartridge and the timing at which the developing drive coupling 40 contacts the drive inputting portion 54 of the cartridge may be offset from each other. This is predetermined since the load applied to the door 31 can be distributed. This can cut the peak of the force applied to the door, and the manipulating force when the door is moved can be reduced.

(Advantage of Positioning the Cartridge Relative to the Side Plate)

In this embodiment, as described above, the position of the cartridge P in the left-right direction is determined by abutting the left-right direction positioning projection portion 57 of the cartridge to the left-hand frame 80L by the spring force of the coupling urging spring (urging member) 211.

The main assembly 100A includes an urging member 211 for urging the cartridge P supported on the tray 35 from one end portion side to the other end portion side with respect to the direction perpendicular to a tray movement plane along which the tray 35 moves between the inside and the outside of the main assembly 100A. In this embodiment, the urging member 211 is included in the drive transmission members 39, 40 to the cartridge P.

By the cartridge P being pressed and urged by the urging member 211 when the tray 35 carrying the cartridges P is in the accommodating position C, the positioning projection 57 abuts to the left-hand frame 80L so that the position of the cartridge P is determined in the perpendicular direction. The urging and the releasing of the cartridge P are carried out in interrelation with the opening and closing operation of the door 31.

The perpendicular direction is a longitudinal direction (drum axis direction of the cartridge P and is the left-right direction, in this embodiment. The left-hand frame 80L is a fixed side plate opposed to the other end portion side of the cartridge P) carried on the tray 35 with respect to the perpendicular direction.

By doing so, the positional accuracy of the main assembly electrical contact spring 75 and the cartridge electrical contact can be improved. The stroke of the main assembly electrical contact spring 75 can be reduced, and the manipulating force required for opening and closing the door 31 by the user can be reduced.

In addition, it is preferable that the positioning portions of the other units are provided also on the left-hand frame 80L, so that the positional accuracy of each unit relative to the cartridge P is improved.

In this embodiment, the left-hand frame 80L to which the cartridge P is positioned is provided with the main assembly electrical contact spring 75 which is the electrical contact unit for electrical connection with the cartridge P. The positioning thereof with respect to the drum axis direction is effected by the left-hand frame 80L. That is, the electrical contact unit 75 for the electrical connection with the cartridge P is provided with the left-hand frame 80L side. The electrical contact unit 75 is positioned by the left-hand frame 80L in the perpendicular direction.

The laser scanner unit (exposing unit) 11 is positioned and fixed by the positioning portion (longitudinal direction (left-right direction of the main assembly) of the exposure device holding member (unshown) for holding the unit (exposure device) 11 being abutted to the left-hand frame 80L. Thus, the exposure device holding member is positioned by the left-hand frame 80L with respect to the perpendicular direction. By this, the projection positional accuracy of the laser relative to the drum 1 can be improved.

In addition, for the intermediary transfer belt unit 12, the positioning portion (unshown) thereof with respect to the longitudinal direction (left-right direction of the main assembly) is positioned and fixed relative to the left-hand frame 80L. The developer image is primary-transferred from the drum 1, and the developer image is secondary-transferred onto the recording material S by the intermediary transfer unit 12, which is positioned in the perpendicular direction by the left-hand frame 80L.

By this, the positional accuracies of the belt 13, the driving roller 14, the turning roller 15, the tension roller 16 and the primary transfer roller 17 relative to the drum 1 are improved. By this, the dimensions, in the left-right direction, of the drum 1, the belt 13, the driving roller 14, the turning roller 15, the tension roller 16 and the primary transfer roller 17 can be reduced. That is, the main assembly can be downsized in the left-right direction and the cost can be reduced.

As to the fixing device (fixing unit) 23, the positioning portion (unshown) with respect to the longitudinal direction (left-right direction of the main assembly) can be abutted to and positioned by the left-hand frame 80L. The fixing unit 23 for fixing the toner image by the heat and pressure on the recording material S can be positioned in the perpendicular direction by the left-hand frame 80L.

By this, the positional accuracy of the fixing device 23 can be improved. By effecting the positioning of the fixing unit 23 by the left-hand frame 80L, the deviation between the fixing members 23*a* and 23*b* and the developer image on the belt 13 in the left-right direction can be reduced. By this, the dimension of the fixing members 23*a* and 23*b* in the left-right direction of the main assembly can be reduced. That is, the main assembly can be downsized in the left-right direction and the cost can be reduced.

The positioning of the sheet feeding unit 18 for feeding one by one the recording materials S, in the perpendicular direction is effected by the left-hand frame 80L. By this, the deviation, in the left-right direction, between the developer image on the belt 13 and the recording material S fed from the sheet feeding unit 18 can be reduced, and the deviation in the left-right direction of the printed image relative to the recording material S can be reduced.

[Others]

In the present invention, the cartridge P is not limited to an integral type process cartridge including an image bearing member 1 on which the latent image is formed and the developing means 3 for developing the latent image formed on the image bearing member with the developer.

The cartridge P may be a separable type process cartridge including the image bearing member 1 and an image forming process means other than the developing means.

The cartridge P may be a developing cartridge including the developing means for developing the latent image formed on the image bearing member 1 with the developer and a developer accommodating portion for accommodating the developer.

The cartridge supported by the tray 35 is a pair (combination) of the separable type process cartridge and the developing cartridge. At least one of the process cartridge and the developing cartridge may be dismountably supported by the tray 35.

The cartridge may be a unit which is contributable to the image forming process for forming the image on the recording material and which is dismountably mountable to the main assembly A.

In the embodiment, a full-color electrophotographic image forming apparatus to which four cartridges including different color developers are detachably mountable has been taken as an example. However, the number of the cartridges is not limited to four, and one ordinary skilled in the art can properly select it. It may be one, two, three or more than four. This is applicable to the case of a monochromatic image forming apparatus using one cartridge.

In the foregoing embodiments, the tray 35 is movable linearly in the horizontal direction. However, the tray (cartridge supporting member) 35 in the present invention is not limited to this example. For example, the tray 35 may be movable linearly in a horizontal direction crossing with the longitudinal direction of the drum 1, or in an inclined upward or downward direction. The tray 35 may be dismountable from the main assembly 100A by releasing the stopper.

In the image forming apparatus 100 of the embodiment, the intermediary transfer unit 12 may be replaced with a recording material feeding transfer belt device for carrying the recording material S. In such a case, the developed image is transferred directly onto the recording material.

The image forming apparatus is not limited to the above-described one. It may be a copying machine, a facsimile machine, a multifunction machine having the functions of both of them, or another image forming apparatus.

The image forming process of the image forming apparatus is not limited to the electrophotographic process. It may be an electrostatic recording process using a dielectric member for electrostatic recording as the image bearing member, or a magnetic recording process using a magnetic member for magnetic recording.

According to the present invention, the downsizing and weight reduction of the main assembly of the image forming apparatus, the cost reduction, and the usability improvement can be accomplished.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 259762/2013 filed Dec. 17, 2013, which is hereby incorporated by reference.

What is claimed is:

1. An image forming apparatus, to which a cartridge is detachably mountable, for forming an image on a recording material, said apparatus comprising:

a main assembly including an opening;

a cartridge tray for dismountably supporting a cartridge, said cartridge tray being movable through the opening between an outer position and an inner position;

an openable member for opening and closing the opening;

said cartridge tray being provided, at one end portion side of said cartridge tray with respect to a longitudinal direction of said cartridge, with a regulating member which is engaged with a main assembly side engaging portion of said main assembly to regulate movement of said cartridge tray toward the outer position when said cartridge tray is in the inner position;

at least one urging member, provided upstream of said regulating member with respect to an outward direction which is from the inner position toward the outer position, for urging said cartridge tray from the inner position toward the outer position; and a locking member movable between a regulating position and a non-regulating position in interrelation with movement of said openable member, wherein when said openable member is closed, said locking member moves to the regulating position at which said locking member engages with the other end portion side of said cartridge tray with respect to the longitudinal direction to push said cartridge tray to the inner position and regulates movement of said cartridge tray toward the outer position, and wherein when said openable member is opened, said locking member moves to the non-regulating position at which said locking member disengages from said cartridge tray.

2. An apparatus according to claim 1, wherein said urging member is provided at each of the one end portion side and the other end portion side.

3. An apparatus according to claim 1 or 2, wherein at least one of said urging member is electroconductive, and said cartridge tray is provided with an electroconductive member electrically connectable with said electroconductive urging member in the inner position, and wherein when said cartridge is mounted on said cartridge tray, said electroconductive member electrically connects with an electrical contact member provided on the cartridge.

4. An apparatus according to claim 2, wherein said electroconductive member is provided at an end portion of said cartridge tray to reinforce said cartridge tray.

5. A apparatus according to claim 1, further comprising a first reinforcing member, provided at one end portion side of said cartridge tray, for reinforcing said cartridge tray, a second reinforcing member, provided at the other end portion side of said cartridge tray, for reinforcing said cartridge tray.

6. An apparatus according to claim 1, wherein said main assembly further includes a main assembly drive transmission member, and wherein said main assembly drive transmission member is engageable with said cartridge mounted to a mounting position where said image forming apparatus is capable of forming the image, at the one end portion side of said cartridge tray to enable transmission of a driving force to the cartridge.

7. An apparatus according to claim 1, wherein said regulating member is movable in the inner position between a regulating position in which said regulating member engages with said main assembly side engaging portion and a disengagement position in which said cartridge tray is disengaged from the main assembly side engaging portion, wherein said cartridge tray is provided with a releasing member for moving said regulating member from the regulating position to the disengagement position.

8. An apparatus according to claim 1, wherein the cartridge includes a rotatable member, wherein the longitudinal direction is a direction of a rotational axis of the rotatable member.

9. An apparatus according to claim 1, wherein a moving direction of said cartridge tray between the inner position and the outer position is substantially perpendicular to the longitudinal direction of the cartridge mounted on said cartridge tray.

10. An apparatus according claim 1, wherein said cartridge tray is capable of supporting a plurality of cartridges along a moving direction between the inner position and the outer position.

11. A apparatus according to claim 1, wherein said cartridge tray is linearly movable between the inner position and the outer position in a horizontal direction, in an oblique upward direction or in an oblique downward direction.

12. An apparatus according to claim 1, wherein in the outer position, said cartridge tray supports the cartridge so that the cartridge is dismountable from said cartridge tray upwardly, and the cartridge is moved downwardly to be supported by said cartridge tray.

13. A apparatus according to claim 1, wherein the cartridge is a process cartridge including a rotatable image bearing member on which a latent image is formed and developing means for developing the latent image with a developer.

14. An image forming apparatus according to claim 1, wherein the cartridge is a separate process cartridge including a rotatable image bearing member on which a latent image is formed, and image forming process means other than developing means for developing the latent image with a developer.

15. An apparatus according to claim 1, wherein the cartridge is a developing cartridge including rotatable developing means for developing a latent image formed on an image bearing member with a developer, and a developer accommodating portion containing the developer for developing the latent image.

16. An apparatus according to claim 1, wherein the cartridge is a separate process cartridge including a rotatable image bearing member on which a latent image is formed, image forming process means other than developing means for developing the latent image with a developer, a developing cartridge including rotatable developing means for developing the latent image formed on the image bearing member with a developer, and a developer accommodating portion containing the developer for developing the latent image.

17. An apparatus according to claim 13, wherein the image bearing member is a rotatable electrophotographic photosensitive member.

18. An apparatus according to claim 1, wherein said locking member is provided at said main assembly.

19. An apparatus according to claim 1, wherein said at least one urging member provides a resultant force effective to apply a rotational force to said cartridge tray in a direction of projecting the other end portion side beyond the one end portion side, when said regulating member engages with said main assembly side engaging portion.

* * * * *